US007925375B2

(12) United States Patent
Schininger et al.

(10) Patent No.: US 7,925,375 B2
(45) Date of Patent: Apr. 12, 2011

(54) STORAGE MACHINE FOR OBJECTS

(75) Inventors: Manfred Schininger, Linz (AT); Claus Peham, Linz (AT); Ernst Schacherl, Linz (AT)

(73) Assignee: KEBA AG, Linz (AT)

( * ) Notice: Subject to any disclaimer, the term of this patent is extended or adjusted under 35 U.S.C. 154(b) by 892 days.

(21) Appl. No.: 11/596,511

(22) PCT Filed: Apr. 28, 2005

(86) PCT No.: PCT/AT2005/000145

§ 371 (c)(1),
(2), (4) Date: Aug. 6, 2007

(87) PCT Pub. No.: WO2005/111954

PCT Pub. Date: Nov. 24, 2005

(65) Prior Publication Data

US 2008/0121646 A1 May 29, 2008

(30) Foreign Application Priority Data

May 14, 2004 (AT) ..... A 841/2004

(51) Int. Cl.

| | |
|---|---|
| ***G06F 7/00*** | (2006.01) |
| ***G06F 17/00*** | (2006.01) |
| ***G06F 11/30*** | (2006.01) |
| ***G07F 11/00*** | (2006.01) |
| ***B65H 3/00*** | (2006.01) |

(52) U.S. Cl. ..... 700/214; 700/236; 700/237; 700/242; 221/131; 221/192; 221/189

(58) Field of Classification Search ..... None
See application file for complete search history.

(56) References Cited

U.S. PATENT DOCUMENTS 4,317,604 A * 3/1982 Krakauer ..... 312/97.1
(Continued)

FOREIGN PATENT DOCUMENTS

DE 33 36 565 4/1985
(Continued)

OTHER PUBLICATIONS

International Search Report.
(Continued)

*Primary Examiner* — Gene Crawford
*Assistant Examiner* — Yolanda Cumbess
(74) *Attorney, Agent, or Firm* — Collard & Roe, P.C.

(57) ABSTRACT

A machine for storing objects includes a compartment system with a plurality of compartments and having at least one closure mechanism which can be moved relative to a central, predefined access orifice in the machine housing to permit or prevent access to a specific, individual compartment or to a specific group of adjacent compartments. A driving force of the drive system for the closure mechanism is dimensioned or can be set and/or a drive train or a motion transmitting path between the drive system and closure mechanism has a force or torque limiting device such that maximum force or torque transmitting values acting on the closure mechanism are fixed or can be set so that automatic movements of the closure mechanism can not cause serious injuries to a user, and in addition the closure mechanism can be manually held open or pushed open in spite of the active drive system. The closure mechanism or drive system co-operates with at least one stop mechanism which can be activated and/or deactivated in a controlled manner or positioned in a controlled manner, which is designed mechanically to restrict a maximum permissible opening width of the closure mechanism). This results in an increased degree of personal safety and at the same time protects access to the storage machine.

47 Claims, 13 Drawing Sheets

U.S. PATENT DOCUMENTS

| | | | | |
|---|---|---|---|---|
| 4,828,095 | A | 5/1989 | Kilwin | |
| 5,212,649 | A | 5/1993 | Pelletier et al. | |
| 5,385,265 | A | 1/1995 | Schlamp | |
| 5,638,985 | A * | 6/1997 | Fitzgerald et al. | 221/125 |
| 5,730,316 | A | 3/1998 | Falk | |
| 6,142,373 | A | 11/2000 | Claassen | |
| 6,502,718 | B2 * | 1/2003 | Fitzgerald et al. | 221/131 |
| 7,086,198 | B2 * | 8/2006 | Hayden | 47/41.01 |
| 7,228,200 | B2 * | 6/2007 | Baker et al. | 700/236 |
| 7,395,945 | B2 | 7/2008 | Godlewski | |
| 7,735,680 | B2 | 6/2010 | Godlewski | |
| 2001/0034665 | A1 | 10/2001 | Kinory et al. | |
| 2002/0032501 | A1 | 3/2002 | Tilles et al. | |
| 2002/0035515 | A1 | 3/2002 | Moreno | |
| 2002/0156645 | A1 | 10/2002 | Hansen | |
| 2002/0184497 | A1 | 12/2002 | Gage et al. | |
| 2003/0040980 | A1 | 2/2003 | Nakajima et al. | |
| 2005/0160281 | A1 * | 7/2005 | Thibadeau | 713/189 |

FOREIGN PATENT DOCUMENTS

| | | | |
|---|---|---|---|
| DE | 199 39 744 | | 2/2001 |
| DE | 102 46 650 | | 4/2004 |
| EP | 0 703 334 | A1 | 3/1996 |
| EP | 0 749 101 | A2 | 12/1996 |
| EP | 1 403 830 | | 3/2004 |
| JP | 03-221014 | | 9/1991 |
| JP | 10-188105 | | 7/1998 |
| WO | WO 01/43091 | | 6/2001 |
| WO | WO 01/78022 | | 10/2001 |
| WO | WO 2004/114234 | | 12/2004 |
| WO | WO 2005/111954 | | 11/2005 |

OTHER PUBLICATIONS

International Preliminary Report on Patentability (English translation).

* cited by examiner 39
40
19
4
3
9
3
3
A
B
C
O
11
7
5
28
33
6
38
26
37
8
22
21
13
14
34
36
27
31
29
17
16
53
30
31
53
33
32
1
2

2
64
62
61
58
59
30
56
57
13
27
47
52
29
49
31
34
51
32
36
33
45
46
41
42
55
54
53
26
28
6
7
11
5

STORAGE MACHINE FOR OBJECTS

CROSS REFERENCE TO RELATED APPLICATIONS

Applicants claim priority under 35 U.S.C. §119 of Austrian Application No. A841/2004 filed May 14, 2004. Applicants also claim priority under 35 U.S.C. §365 of PCT/AT2005/000145 filed Apr. 28, 2005. The international application under PCT article 21(2) was not published in English.

The invention relates to a machine for storing objects, of the type described in claim 1.

Patent specification EP 0 749 101 A2 discloses a machine for storing objects of the generic type, in particular a self-service vending machine for selling items to be purchased. This storage machine has a drum-shaped circular magazine with several compartment levels and several compartments disposed in sectors in every compartment level. Every compartment level is provided with a slide, which can be opened and closed by a drive motor. This being the case, allowance is made for the different opening widths of the slide which is adapted to the compartment widths lying behind along the displacement path of the drive motor. In particular, the opening movement is controlled by a sensor-operated pulse detection system on a slotted disc or time disc on the drive motor. On the basis of these technical options used for monitoring and restricting the opening of the slide, the slide can also be closed again via the drive motor on an automated basis. Accordingly, the closing movement is monitored on the basis of the revolutions or signals of the pulse disc and the motor is stopped when the slide has reached the closed position. During the closing movement of the slide, the closing resistance is also detected by sensors. If an increased resistance to closing is detected, for example via the motor current or due to fluctuations in the signals from the transmitter disc, the direction of rotation of the motor is reversed and the slide is opened again so that another attempt at closure can be initiated again after a specific amount of time has elapsed. A storage machine of this type with an opening width which is variably controlled exclusively by means of drive technology or the drive motor is not satisfactory, in particular as regards many safety aspects.

The underlying objective of this invention is to propose a machine for storing objects, which on the one hand offers improved personal safety, i.e. greater protection of untrained users against injury, and simultaneously satisfies stringent requirements in terms of security as regards attempts at theft and tampering.

This objective is achieved by the invention on the basis of a storage machine as defined in claim 1. The advantage of this approach is that, due to the functional or structural uncoupling between a controllable opening restriction for the closure mechanism and the drive system for the closure mechanism, which can be controlled on an automated basis, better personal safety and protection against injury can be achieved because strong closing and retaining forces do not have to be expended by the drive mechanism to prevent specific manipulation attempts. The high security against unauthorized access, attempts to break in or other manipulations during authorized access is achieved by the controllable opening restriction in the form of a stop mechanism. Due to the moving coupling based on a limited force or limited torque between the automated actuatable drive system and the mechanical closure mechanism in particular, serious injuries such as trapping of what will usually be an untrained user can be virtually ruled out. Via the stop mechanism, which can be activated and deactivated independently via the drive system and variably positioned independently of the drive system, access can be controlled using control technology and the size of the access orifice can be reliably limited on the basis of the various access rights which can be automatically verified. The maximum permissible access dimensions can be reliably operated in particular, and any unauthorized widening of the access orifice is reliably prevented via the stop mechanism, which can be positioned and activated on a controlled basis. The storage machine proposed by the invention is also safe for operating personnel, being of a relatively high total bearing weight and having a high maximum weight when full, which makes the use of strong transport drives necessary.

The design defined in claim 2 advantageously ensures that excess strain or excessive wear on the force or torque limiting system is avoided if the closure mechanism can no longer be opened or can no longer be closed on an automated basis.

The embodiment defined in claim 3 results in a self-service vending machine which automatically controls the access options to the machine compartments depending on the use, application and different access rights or correct compartment accesses.

The improved design defined in claim 4 ensures that an unlocked closure mechanism can be manually displaced when the drive system is both in the active state and in the inactive state. In particular, an unlocked closure mechanism or a slide unlocked by mechanical control means can be displaced between the almost closed position and the variably pre-definable position defined by the stop mechanism by applying manual force at all times and an automatic displacement can be stopped at any time. As a result, injuries can be avoided and it is easily possible to move automatically out of the way of automatically closing or opening closure mechanisms or slides.

The features defined in claim 5 ensure that access rights of the respective users, which can be checked on an automated basis, can not be extended or changed without authorization, thereby thwarting break-ins or attempts at theft, as a rule, and counteracting such attempts at manipulation with sufficient resistance.

The opening restriction defined in claim 6 enables the maximum opening width of the closure mechanism to be mechanically limited automatically depending on the respective compartment widths and the respective access rights of the various users, and the closure mechanism can not be blocked, stopped or otherwise held after unlocking from the fully closed position—apart from relatively low friction forces in the rigidly coupled parts of the respective drives system and in the different bearing positions.

Due to the features defined in claim 7, a plurality of different compartment sizes can be reliably and safely closed and locked via a single closure mechanism and released again once the respective access rights have been verified accordingly.

The embodiment defined in claim 8 offers several stop positions which can be activated on a defined and controlled basis or maximum opening widths which can be set on a defined and controlled basis.

The embodiment defined in claim 9 results in high security against abusive manipulation attempts with regarding to compartment access rights. In particular, the maximum access dimensions are already fixed and predefined before the closure mechanism is unlocked or released and only then is an automated and/or manual displacement of the closure mechanism possible.

The embodiment defined in claim 10 ensures that serious injuries to users can be prevented, whether they be children or adults, with a minimal residual risk, in spite of using a closure mechanism which at least closes on an automated basis and optionally opens on an automated basis.

A variation or adjustment can be easily made to the driving power as a result of the embodiment defined in claim 11.

Of particular advantage is an improved embodiment defined in claim 12, because allow-ance can be made for the need for a stronger force or torque at the start of the movement by means of the controllable power adjusting element, and once the movement of the closure mechanism has ended, the driving force can be easily reduced again by simple control technology. Alternatively or in combination, the requisite drive torque can be easily adapted to closure mechanisms of different sizes, weights and hence different inertia levels.

A reliable, robust and structurally simple and economic force or torque restriction can be achieved as a result of the embodiment defined in claim 13 and/or 14.

An inexpensive and technically simple automation in terms of control can be achieved by the embodiment defined in claim 15.

The design defined in claim 16 permits a plurality of controlled variable or quasi continuously variable stop positions, and allowance can easily be made for a plurality of different compartment sizes without having to opt for a more complex design as the number of different compartment sizes increases.

A reliable and, in the case of a machine or actuator drive with no energy, effective as well as structurally reliable restriction of the movement of the closure mechanism at the respective stop positions necessary is achieved as a result of the embodiment defined in claim 17.

As a result of the features defined in claim 18, different stop positions which can be activated and deactivated as and when necessary by means of several stop mechanisms can be obtained in a simple manner.

As a result of the features defined in claim 19, the number of actuator drives needed for control purposes can be reduced, even though a plurality of stop positions is still available.

The stop mechanism can be fixed so that it can not move, thereby resulting in a reliable fixing of the opening restriction as a result of the embodiment defined in claim 20 and/or 21.

Of particular advantage is the embodiment defined in claim 22, because in the event of criminal manipulations to the power supply or control system of the machine, it is only possible for opening to take place as far as the first stop mechanism, if the tumbler of the closure mechanism has been deactivated or released beforehand by someone applying criminal force and also in the event of normal access to a compartment.

Also of advantage is an embodiment defined in claim 23, because two different, stable positions can be assumed without applying electrical energy, and a constant supply of energy is not needed in order to maintain them.

As a result of the features defined in claim 24, the closure mechanism is reliably locked in the closed position so that unauthorized attempts to open it by unauthorized persons are thwarted. Providing a tumbler for every available closure mechanism also means that a co-operating closure mechanism can be selectively released by the control device and the other tumblers continue to remain active and the other closure mechanisms remain safely locked as before.

As a result of the embodiment defined in claim 25, a reliable access sequence of the various machine functions can be obtained on an automated basis.

As a result of the features defined in claim 26 and/or 27, significantly better error protection and error detection can be obtained with respect to the function sequences, in particular the control sequences of the machine relevant to controlling personal safety. Safetyrelevant modes and conditions are not only applied on a controlled basis, an active check is run to ensure that they actually exist.

The embodiment defined in claim 28 ensures that in the event of a power failure for a longer period and also on expiry of a bridging time by an integrated uninterruptible power supply or also in the event of malicious interruption of the power supply to the machine, the closure mechanism is locked and remains locked.

A reliable and inexpensive control device for monitoring a plurality of closure mechanisms is defined in claim 29 and/or 30.

The embodiment defined in claim 31 advantageously obviates the need for additional sensors or detection means for the control system used to check the lock status of the tumbler. Furthermore, additional options are provided for checking manipulations or damage to the tumblers.

An advantageous variant of the stop mechanism is defined in claim 32 and/or 33. This likewise enables variable opening restrictions to be obtained on a controlled basis.

The embodiment defined in claim 34 obviates the need to fit separate stop elements, thereby reducing the work involved in assembly.

The embodiment defined in claim 35 and/or 36 results in a simple yet reliable design of a stop mechanism.

The design defined in claim 37 relates to a stop mechanism that is reliable in terms of manipulation, fail-safe and easy to integrate in the control system.

The embodiment defined in claim 38 ensures that a plurality of compartments of a compartment system can be selectively positioned in a controlled and predefined way in the immediate vicinity of the closure mechanism, thereby making them readily accessible to a user.

The embodiment defined in claim 39 on the one hand increases the performance of the machine as well as safety during manipulation as well as personal safety, because any attempt to move the compartment system when a closure mechanism is open is reliably thwarted.

A compartment system enabling a plurality of compartments to be set up is defined in claim 40, whereby the relative displacement of the compartments with respect to the closure mechanism can be achieved in a simple and robust manner.

As a result of the embodiment defined in claim 41, the control system ensures that the tumblers for the closure mechanisms can reliably be prevented from unlocking before the compartment has come to a standstill and been secured, which would otherwise leave potentially dangerous machine parts accessible. Injuries can be virtually ruled out as a result.

Personal safety with respect to any danger from the transport mechanism as the closure mechanism is being opened can be guaranteed independently of the programmable control system due to the embodiment defined in claim 42. In particular, it is not possible to access the compartment system or a specific compartment until stationary parts, in particular a decelerated compartment system, no longer pose a risk.

The embodiment defined in claim 43 guarantees personal safety with regard to any risk from the transport mechanism if the closure mechanisms are open independently of the programmable control system.

Also of advantage is an embodiment defined in claim 44, because it facilitates and speeds up the task of filling the storage machine with objects or carrying out any maintenance and inspection work for trained persons, in particular for professional delivery services and service engineers, without exposing the user to any unacceptable risk.

Also of advantage in this respect is an embodiment defined in 45, because the intuitive way in which the OK button is used permits rapid and reliable initiation of safety-relevant features, in particular features for stopping the transport mechanism for the compartment system.

Also of advantage is an embodiment defined in claim 46, because its offers a two-handed control system whereby two buttons have to be depressed simultaneously in order to release a drive, in particular the compartment drive, and the buttons are disposed in such a way that it is necessary to use both hands in order to operate them simultaneously. What is ideal about this approach is that during this operation, no other body parts are within range of the area which might otherwise pose a risk, in particular in the region of the access orifice or compartment system. This can be achieved by disposing the buttons at a sufficient distance from the area posing a risk.

Finally, the features defined in claim 47 enable the safety of a user as well as general personal safety to be increased.

The invention will be described in more detail below with reference to examples of embodiments illustrated in the appended drawings.

Of these:

FIG. 6 to 13 are simplified, schematic diagrams illustrating other advantageous embodiments of the controllable access mechanism for the storage machine.

Figure 1:
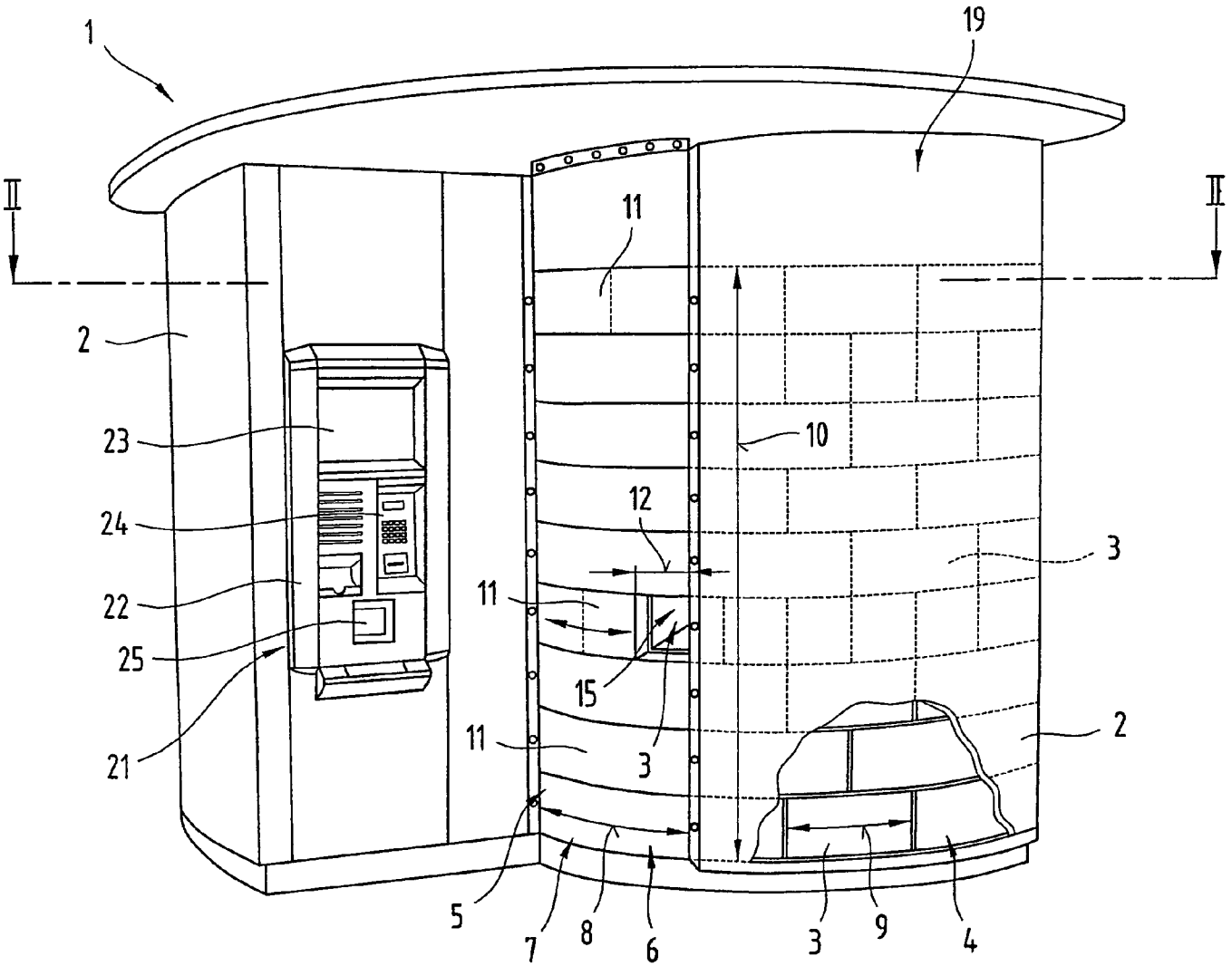
FIG. 1 is a schematic front view in perspective, illustrating one embodiment of the storage machine proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
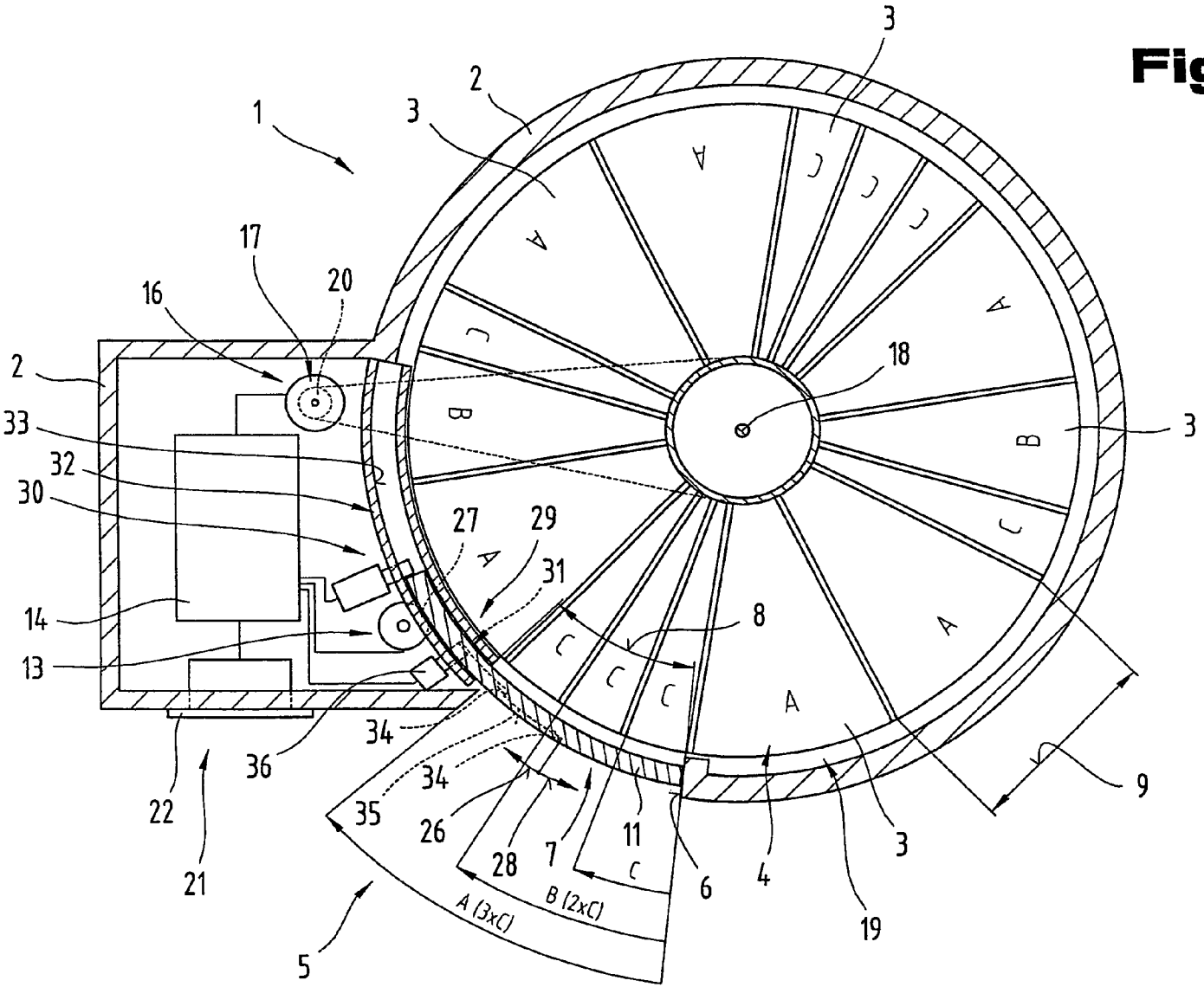
FIG. 2 is a simplified, schematic diagram showing the storage machine illustrated in FIG. 1, viewed in section along line II-II indicated in FIG. 1.

FIGS. 1 and 2 provide a schematic illustration of one possible embodiment of a storage machine proposed by the invention. An electromechanical storage machine 1 for various objects or goods is preferably used as a parcel deposit or parcel dispensing machine for the postal service or delivery services. Such a storage machine 1 may optionally also be designed for use as a vending machine for goods or for use at a left-luggage office in railway stations or airports. However, a storage machine 1 of this type may also be adapted so that it can be used for the renting or hire of different types of objects, such as tools, for example, or as a drop-off and collection station for various services, such as dry cleaning, photographic processing, repairs and similar. It may likewise be used as a locker system for clothing, for example at swimming pools or fitness centers, for example.

In particular, such a storage machine 1 may be used for temporarily storing objects or for transferring objects between different persons present at the hand-over point, i.e. the storage machine 1, at different points in time. However, such a storage machine may also be used for dispensing or selling objects without the need for sales personnel to be present.

The storage machine 1 has a machine housing 2, which is strong enough to prevent unauthorized access and vandalism and which essentially defines the external contour of the machine. The machine housing 2, which is access-proof and burglar-proof in particular, is therefore designed as a mechanical access protection for the objects stored inside the machine. This being the case, parts of the machine housing 2 may also be provided with some other system surrounding them, such as a wall structure or similar, for example, thereby protecting the respective objects against unauthorized access.

The machine housing 2 surrounds at least some portions of a plurality of compartments 3, which are provided as a means of temporarily depositing a plurality of objects or goods. The compartments 3 may be laid out in a field or matrix pattern or alternatively may be of a carousel or magazine type structure. This means that inside the machine housing 2, a matrix-pattern or field pattern or a round magazine-type compartment system 4 can be set up, with a plurality of individual compartments 3 open at one side. The compartments 3 of the compartment system 4 are preferably designed in at least two different sizes, to permit the stowage of parcels or objects of different sizes. In the embodiment illustrated as an example, three compartment sizes are provided. In particular, large compartments A, medium-sized compartments B and small compartments C are provided.

The individual compartments 3, preferably of different sizes, in particular with different width dimensions, may optionally contain special devices for storing specific objects, such as retaining mechanisms, cups, compartment dividers or similar. The compartments 3 may also contain devices for creating specific storage conditions, such as heating devices, cooling devices, air humidifiers, lighting units, moving mechanisms, devices for creating a protected atmosphere or for germ-free storage and similar, for example, and are connected to such devices.

To enable access to individual or specific; compartments 3 of the compartment system 4 to be controlled on an automated basis, the storage machine 1 also has at least one access mechanism 5. In particular, the machine housing 2 is provided with at least one access orifice 6 to compartments 3 of the compartment system 4 which can be selectively released and locked. This access orifice 6 in the machine housing 2 or in some other surround of the machine, the size of which is predefined in terms of its width and height dimensions in particular, is preferably disposed in a central position of the machine housing 2. This access orifice 6 in the machine housing 2 can be released at least partially or in some regions or alternatively completely closed or locked to prevent access by means of at least one closure mechanism 7 which can be displaced relative to the access orifice 6 or relative to the machine housing 2. Due to a co-operation between the access orifice 6 in the machine housing 2, which is of predefined dimensions, and the closure mechanism 7, access options can be selectively granted or prevented for a specific individual compartment 3 or a specific compartment group. A largest width 8 of the access orifice 6 essentially corresponds to a compartment width 9 of the biggest compartment 3A of the compartment system 4. A height 10 of the biggest possible access orifice 6 in the machine housing 2 essentially corresponds to the total height of the compartment system 4 lying behind. In other words, the vertical dimension of the access orifice 6 or the access opening of fixed maximum size in the machine housing 2 essentially corresponds to the biggest height of the compartment system 4. In the preferred embodiment based on a carousel or round magazine-type compartment system 4, the access orifice 6 extends across all the compartment levels disposed one above the other.

As a result, a free cross-section or orifice size of the access orifice 6 provided in the machine housing 2 is preferably bigger than the cross-sectional surface of the biggest compartment 3A lying behind at its open front face directed towards the closure mechanism 7. In particular, the central access orifice 6 in the machine housing 2 extends, in terms of its height, at least across one compartment level of the preferably several compartment levels of the compartment system 4 and in the direction of the width at least across the compartment width 9 of the widest compartment 3A within the respective compartment level. In the vertical direction, a single access orifice 6 preferably extends across the height of all the compartment levels of the several compartment levels incorporated in the compartment system 4. Alternatively, it would also be possible to provide separate access orifices 6 in the machine housing 2 for the compartment levels, the widths 8 of which are adapted to the width of the widest compartment 3A in the respective compartment level.

It would also be conceivable to provide a central access orifice 6 which is merely sub-divided by slim webs, disposed congruently with the compartment bases or compartment dividing planes of the compartment system 4.

The access mechanism 5 or closure mechanism 7, which can be controlled on an automated basis, has one or preferably several slides 11 or has one or several doors, which permit or prevent access to compartments 3 lying behind inside the surround of the access orifice 6.

Every compartment level is respectively provided with a closure mechanism 7 in the form of at least one, preferably a single, slide 11 displaceable in the horizontal direction or guided in the horizontal direction, which, depending on the requisite opening width 12, essentially corresponding to the compartment width 9 of a compartment 3A, 3B, or 3C lying behind, and controls access to the specific compartment 3 for the respective user or for the specific compartment group intended for the respective user.

Adjacent to a compartment 3 of a specific height, several compartments 3 of a shorter height may also optionally be provided in a specific vertical pattern. The vertical dimensions of the closure mechanisms 7 and their positions correspond to the vertical pattern.

To enable the closure mechanism 7 or at least a slide 11 to be displaced automatically, at least one drive system 13 is provided. A reversible drive system 13 is preferably provided for every slide 11 of the closure mechanism 7. Alternatively, it would also be possible to provide a drive system 13 by means of coupling mechanisms co-operating with several slides 11 which can be selectively activated and deactivated. This at least one drive system 13 for the closure mechanism 7 is designed to control the positioning of the closure mechanism 7 or the respective slide 11 as a function of the respective size, in particular the compartment width 9, of a compartment 3A, 3B or 3C to be accessed by an authorized user. In particular, the opening width 12 of the closure mechanism 7 or the individual slide 11 may be varied so that the opening width 12 corresponds either to the width of compartment A, or the width of compartment B or the width of compartment C, as a result of which the user is afforded access only to the respective compartment 3 intended for the user or to an authorized compartment group, and all the other compartments 3 behind the closure mechanism 7 or the slides 11 and the machine housing 2 remain protected against access. By compartment group in this context is meant a specific group of adjacent compartments 3.

The height of the individually displaceable slides 11 disposed one above the other is adapted more or less to the height of the compartment level lying behind or the height of the compartments 3 within this level of the compartment system 4. Within a compartment level, therefore, a plurality of compartments of differing compartment widths 9 is provided, as may best be seen from FIG. 2.

The individual slide 11 or alternatively several doors of the closure mechanism 7 can preferably be driven or displaced by means of at least one respectively co-operating drive system 13, which can be activated by an electronic control system 14 of the machine. The sum of the compartments 3 in the preferred embodiment of the storage machine 1 is greater than the sum of the individual slides 11 or doors in front of the differently sized compartments 3. The closure mechanism 7 may therefore provide a defined individual access orifice 15 with a size which is variable in at least one but also in two dimensions, as may clearly be seen from a comparison of FIGS. 1 and 2.

The example of an embodiment described above, with slides 11 disposed vertically one above the other, therefore permits controlled individual access at every compartment level to a rearwardly lying compartment portion of the compartment system 4 of the machine inside the machine housing 2, via an access orifice 6 with a relatively large surface area. In particular, an object can be deposited or an object removed through the respective released access portion and via an individual access orifice 15 defined by the closure mechanism 7 in terms of its size and its position relative to the machine housing 2 and relative to the maximum possible access orifice 6. All the other slides 11, which remain closed as before, safely continue to protect against unauthorized access to adjacent compartments 3 and to their compartment contents.

The preferred embodiment of the machine also has a transport mechanism 16, by means of which a controllable relative displacement of the compartments 3 or of the entire compartment system 4 or individual compartment levels can be effected relative to the housing-side predefined maximum access orifice 6 in the machine housing 2. The transport mechanism 16 has at least one drive unit 17 for the displaceably mounted compartment system 4. By preference, the compartment system 4 is provided in the form of a round magazine 19 rotatable about a vertical axis 18, with which a rotary drive 20 co-operates. This rotary drive 20 may be a rotary drive of any type known from the prior art, in particular a gear mechanism, a belt drive, a chain drive or a cable drive. The round magazine 19 is preferably mounted so that its height remains constant, i.e. its compartment levels always remained in the respectively predefined plane and are thus rotatable about the vertically extending axis 18.

To enable the respective functions of the storage machine 1 to be run on an at least partially automated basis, the storage machine 1 is provided with at least one electric or electronic control system 14 or has one integrated in it. In a manner known per se, such an electric control system 14 comprises at least one software-driven processor or micro-controller for controlling, monitoring or regulating at least the internal processes and/or the device functions. To this end, the control system 14 has several electrical or optical interfaces for co-operating actuators and/or sensors of the storage machine 1. The control system 14 also comprises, amongst other things, a standard computer unit for general applications, in particular a standard PC or industrial PC.

The control system 14 also serves as a user interface, in particular what is referred to as a man-machine interface, such as a user interface 21. This user interface 21 is provided in the form of a terminal 6 integrated in the storage machine but may naturally also be provided separately, disposed at some distance from the actual storage machine 1 incorporating the various compartments 3. The user interface 21 or the terminal 22 has input and/or output means 23 of a type known from the prior art for influencing the operating functions or processes of at least the storage machine 1. These input and/or output means 23 may be provided in the form of buttons, switches, displays and/or by combined input and/or output means, such as a touch-sensitive screen otherwise known as a touch-screen, for example. The storage machine 1 preferably also has a document scanner, barcode scanner and receipt printer.

The input and/or output means 24 may also be any identification and/or authorization checking means 24 known from the prior art. An electronic unit of this type for checking persons and authorizations may be provided in the form of a card reader for identity cards or for credit or debit cards (EC cards) and/or in the form of input means for the user's name and optionally for passwords or PIN codes. The user identification may also be based on barcode portions, biometric identification systems, such as fingerprint sensors, speech recognition modules and/or mechanical keys or transponders or a combination of several of such means, for example.

The input and/or output means 23 for data or information and commands may also be provided in the form of optoelectronic scanners 25, magnetic card or chip card readers, electromagnetic transmitter and/or receiver devices and similar and may be integrated in the storage machine 1 and connected to the control system 14.

The amount of electrical or electromechanical equipment provided in the storage machine 1 will essentially depend on the required functions, and it would be conceivable to provide a series of extension stages or special functions for the storage machine 1, as will be explained in more detail below. The electromechanical input and/or output means 23 of the machine also specifically permit a data communication with decentralized sites, in particular with a management center for several storage machines 1 installed at different sites. The input and/or output means 23 also permit communication with the respective users or operators of the storage machine 1.

The transport mechanism 16 enables at least one selected compartment 3 contained in the compartment system 4, which is preferably displaceable as a whole, to be positioned in the access region behind the access mechanism 5. To this end, it is preferable to use the schematically illustrated construction with round or drum-type rotatable magazines or alternatively with paternoster-type compartment systems which are linearly displaceable or circulate on a belt-type system. However, it would also be possible to use machines with stationary compartment systems 4 or magazines which have automatically driven closure mechanisms 7 and correspond to the concept proposed by the invention.

A major advantage of the generic storage machine is the relatively flexible option for splitting the total compartment volume into compartments 3 of different sizes, the layout of which can be adapted to the intended usage conditions, i.e. accommodating storage objects of different sizes. It is preferably also possible to set up the sub-division of the magazine volume after the storage machine 1 has been placed in operation. Such modification or adjustment of the compartment sizes would be possible but difficult if using box-type storage machines or locker compartments where the size of a door has to be adapted to each individual compartment.

The closure mechanisms 7 or the individual slides 11 are preferably moved on an automated basis by the control system 14. In particular, the closure mechanism 7 can be moved in the opening direction—arrow 26—by means of the drive system 13. The respective opening width 12 of the closure mechanism 7 is therefore dependent on the size of the compartment 3 positioned behind or depends on the access rights of the respective user determined beforehand by the electronic input and/or output means 23.

The operation of closing the closure mechanism 7 is preferably effected from the control system 14 via the drive system 13, likewise on an automated basis. In other words, an individual access orifice 15 previously made available to afford access to a compartment, with a specific opening width in the respective compartment level, is completely closed again or moved into the closed position once a defined period has elapsed or following a manual closure command entered by the user once an object has been deposited or once an object has been retrieved. To this end, it is preferable to use the same drive system 13 as that provided for the opening movement of the closure mechanism 7. Closing forces or the maximum force or torque values needed to move the closure mechanism 7 or the individual slides 11 are dimensioned, i.e. predefined or set beforehand, so that a user can not sustain serious injuries due to the automated movements of the closure mechanism 7 or individual slides 11 if his hand, fingers or arms get into the closing range of the closure mechanism 7, in particular between a boundary or closing edge of the closure mechanism 7 and a boundary edge of the access orifice 6 or of the machine housing 2. The force or torque transmission values between the drive system 13 and the closure mechanism 7 or its linear guide or pivot bearing are limited by a force or torque limiting device 27 between the drive system 13 and the closure mechanism 7 and/or by setting or rating the drive system 13 for a low drive output so that injuries to a user which would have to be medically treated and other damage to the health can be virtually ruled out. The driving force of the drive system 13 and/or the maximum force or torque transmission value of the force or torque limiting device 27 is preferably selected so that a closure mechanism 7 moving in the closing direction—arrow 28—can be pushed open or pushed back against the closing force in the opening direction—arrow 26. This movement of the closure mechanism 7 or the slide 11 in the opening direction—arrow 26—can therefore be effected in spite of a drive system 13 which has actually been activated for a closing operation. This deliberately forced opening movement of the closure mechanism 7 against the driving force of the active drive system 13 or against the closing force of the closure mechanism 7 can be effected by hand. In particular, the closing force is dimensioned so low that it is possible to push on the closure mechanism 7 or slide 11 manually, even though an automated closing operation has been initiated by the control system 14 via the drive system 13. Also, whenever the closure mechanism 7 is not locked or not blocked to prevent movement and the drive system 13 is inactive, a manual displacement of a partially opened closure mechanism 7 or a partially opened slide 11 is preferably possible in the opening direction—indicated by arrow 26—as far as a position defined by an opening restriction 29. Permanent clamping or trapping of jamming of limbs, in particular the hand of a machine operator, in an individual access orifice 15 of the storage machine 1 closed on an automated basis can be prevented as a result. This is the case in spite of the fact that the closure mechanisms 7 or slides 11 are set up to be automatically closed.

In spite of this ability to force open or force back a partially opened, i.e. unlocked, closure mechanism 7 manually, the user is prevented from unauthorized access to compartments 3 not intended for him and the risk of injury is minimized due to the manually displaceable displacement drive or drive system 13 for the closure mechanism 7, which is not of a type retained by friction, in combination with the opening restriction 29 for the closure mechanism 7 or slide 11 described above. This opening restriction 29 therefore prevents unauthorized access to compartments 3 disposed adjacent to the specific compartment 3. This means that those compartments 3 which have to remain covered by a partially opened closure mechanism 7 or a partially displaced slide 11 are reliably protected against unauthorized access by means of the opening restriction 29 and in particular remain covered. This is the case even though the drive system 13 is not of a type retained by friction and the closure mechanism 7 is not mechanically blocked once it assumes an opening position or once a tumbler 30 for the closure mechanism 7 has been unlocked and can also be moved or displaced manually. As a result of this embodiment in particular, the closure mechanism 7 can be moved manually between a closed, unlocked position and the position defined by the opening restriction 29. The closure mechanism 7 or the slide 11 can be moved manually, in particular when the locking mechanism(s) or tumbler(s) 30 thereof has or have been deactivated. When the tumbler 30 is in the activated or active mode and when the closure mechanism 7 or slide 11 is in the fully closed position, the closure mechanism 7 or the slides 11 are non-displaceably locked or blocked so that they can not be manually opened or could only be so by applying considerable force or with criminal intent.

The opening restriction 29 has at least one stop mechanism 31 for the closure mechanism 7 or slide 11 and/or for the drive system 13. A stop mechanism 31 of this type may act on a bearing mechanism 32 of the closure mechanism 7, in particular on a guide mechanism 33 for the closure mechanism 7, directly on the closure mechanism 7 and/or on the electric motor-driven, hydraulic or pneumatic drive system 13 for the closure mechanism 7.

However, the opening restriction 29 or stop mechanism 31 is also used to set or limit, on a controlled or automated basis, a maximum possible opening width 12 of the closure mechanism 7 depending on the size of a compartment 3 lying behind, in particular depending on the respective compartment width 9 of the compartments 3A, 3B or 3C. Accordingly, the stop mechanism 31 is activated and positioned depending on the size of the compartment 3 to be accessed, i.e. the stop mechanism 31 activated from a plurality of stop mechanisms 31 is that which limits the maximum permissible opening width 12 for the closure mechanism 7 or for the respective slide 11 positioned accordingly and provided or positioned specifically as a structural means for this purpose.

The stop mechanism 31 or the plurality of stop mechanisms 31 is positioned and activated accordingly by the control system 14. In any event, at least one stop mechanism 31 is provided, which can be positioned or activated and deactivated in a controlled manner by the control system 14, in order to produce the opening restriction 29 required for the closure mechanism 7 or the respective slide 11 on an automated basis.

The maximum force or torque values which act on the closure mechanism 7 in a situation where the drive system 13 has been activated or is inactive or stationary under the control of the system or via the force or torque limiting device 27, can be overcome with relatively little effort and reliably by hand. In particular, even if the hand of a user, for example in the region of the wrist, is pushed by the front closing edge of the closure mechanism 7 against the machine housing 2 or against a side boundary edge of the access orifice 6, the user can simply free the hand, because he can even reverse the closing movement initiated on an automated basis or the then stopped movement of the closure mechanism 7 or slide 11 and can push the closure mechanism 7 or slide 11 open or back at most as far as the position defined by the opening restriction 29 or as far as the active stop mechanism 31. As a result, an object or a body part of the user can be removed without problem from the individual access orifice 15 which has unexpectedly and automatically become smaller due to the closing operation.

By contrast with the closing force of the drive or the drive system 13 for the closure mechanism 7 which can be overcome by hand, the blocking or locking forces of the stop mechanism 31 for the respective slide 11 or closure mechanism 7 can not be overcome by mere manual force. Specifically, it would be necessary to apply considerable force to a degree constituting a break in, using tools, in order to move the closure mechanism 7 or slide 11 out via the respectively active or acting stop mechanism 31 and thus force a wider orifice than the opening width 12 permissible under the control of the system.

The opening restriction 29 or stop mechanism 31 defines at least one stop position 34 which lies between a maximum possible or structurally predefined, maximum achievable opening width of the closure mechanism 7 and the fully closed position of the closure mechanism 7, so that partial opening positions of the closure mechanism 7 or slide 11 are set or permitted in a defined manner. This at least one intermediate stop position 34 is assumed by the stop mechanism 31 or activated by the opening restriction 29 whenever access is intended to be permitted across only a part-portion of the maximum possible opening width or the maximum width 8 of the access orifice 6. This will be the case if the compartment size of the specific compartment 3 in question is smaller than the biggest possible opening path of the closer mechanism 7 that is theoretically possible or is possible due to the structural design.

In a preferred embodiment, the opening restriction 29 or the stop mechanism 31 defines at least two mutually spaced apart stop positions 34, as illustrated in FIG. 2. With the embodiment illustrated in FIG. 2, the various stop positions 34 are formed by step-type stages 35. These stages 35 may be disposed directly on the closure mechanism 7 or preferably on a separate element that is not visible from the outside and which can not be accessed by the user from outside, and is rigidly joined to the closure mechanism 7 or to the respective slide 11. Instead of an element with step-type stages 35, it would also be possible to provide projections of different lengths or grooves of different depths.

As described above, the closure mechanism 7 or each of the slides 11 is provided with a tumbler 30, which, in the active mode, reliably prevents the closure mechanism 7 or the individual slide 11 from being opened starting from the fully closed position and is also readily able to withstand the effects of external force. Before the closure mechanism 7 or a co-operating slide 11 can be switched to the corresponding open disposition or open position or switched automatically, the respective co-operating tumbler 30, which may be provided in the form of a bolt or pawl lock, must be deactivated. The tumbler 30 is deactivated on an automated basis by means of a control command issued by the control system 14. Before the co-operating tumbler 30 is deactivated, it is preferable if the stop mechanism corresponding to the respective access rights is activated or positioned so that only the maximum permissible opening width 12 can be obtained. This means that the opening restriction 29 is activated and automatically moved into the position enabling the closure mechanism 7 to be opened to the legitimate opening width 12 even before the tumbler 30 is deactivated or the slide lock released. Accordingly, the stop mechanism 31 has already been activated and positioned accordingly, before the tumbler 30 is deactivated or released, so that the user can only open the closure mechanism 7 or the respective slide 11 as far as the intended position predefined by the stop mechanism 3 land the closure mechanism 7 is automatically opened as far as this stop mechanism 31, which can be variably controlled or which can be activated or deactivated accordingly in a controlled manner. This variable and automatically defined stop position 31 or opening width for the closure mechanism 7 respectively corresponds to the permissible size for the individual access orifice 15. In any event, the closure mechanism 7 or slide 11 can not be moved beyond the mechanical stop mechanism 31 or beyond the active stop position 34 defined by the opening restriction 29.

When the opening restriction 29 or the stop mechanism 31 is in the state illustrated in FIG. 2, the closure mechanism 7 or slide 11 opens at most by a position width C as soon as the tumbler 30 is deactivated by the control system 14. In this case, the right-hand compartment 3C of the partially released compartment group positioned in front of the access orifice 6 can be accessed in order to deposit or take out objects.

If the opening restriction 29 or its variable stop mechanism 31 were moved into an intermediate position between a non-operating position and a maximum active position, the other stop position 34 would come into play and a compartment 3 of size B would therefore be accessible. In the position of the compartment system 4 illustrated, two compartments 3 of size C would be accessible, for example.

When the opening restriction 29 is in the third position, the opening restriction 29 is deactivated and therefore no stop position 34 is predefined by the opening restriction 29, in which case the closure mechanism 7 or slide 11 opens to the maximum width and is automatically opened. In this state, a compartment 3 of size A can be accessed. The positioning of the respective compartment size or the specific compartment 3 of the plurality of compartments 3 behind the housing-side access orifice 6 takes place automatically by means of the transport mechanism 16, which is likewise activated accordingly by the control system 14. If the position of the displaceable, in particular rotatable compartment system 4 remains unchanged, three compartments 3 of size C would be accessible within the illustrated compartment level on the basis of the example illustrated in FIG. 2.

The opening restriction 29 or stop mechanism 31 may be an electromagnetically operated stop element 36 with at lest two defined adjustment positions. A stop element 36 of this type may be provided in the form of a tension rod magnet, for example, which assumes a first adjustment position in the deactivated state and at least a second adjustment position spaced at a distance apart from it in the activated or energized state. When the opening restriction 29 is in the powerless state or is not being supplied with power, the opening restriction 29 is preferably mechanically active, i.e. either it is not possible to open the closure mechanism 7 or the closure mechanism 7 is able to travel by only the smallest displacement path, i.e. the opening path corresponding to the smallest or narrowest compartment 3 or only the smallest opening width 12C. However, the opening restriction 29, which can be variably positioned, may also comprise an electrically activated stepper motor with a downstream limiting or locking mechanism for restricting the positioning width of the closure mechanism 7.

Figure 3:
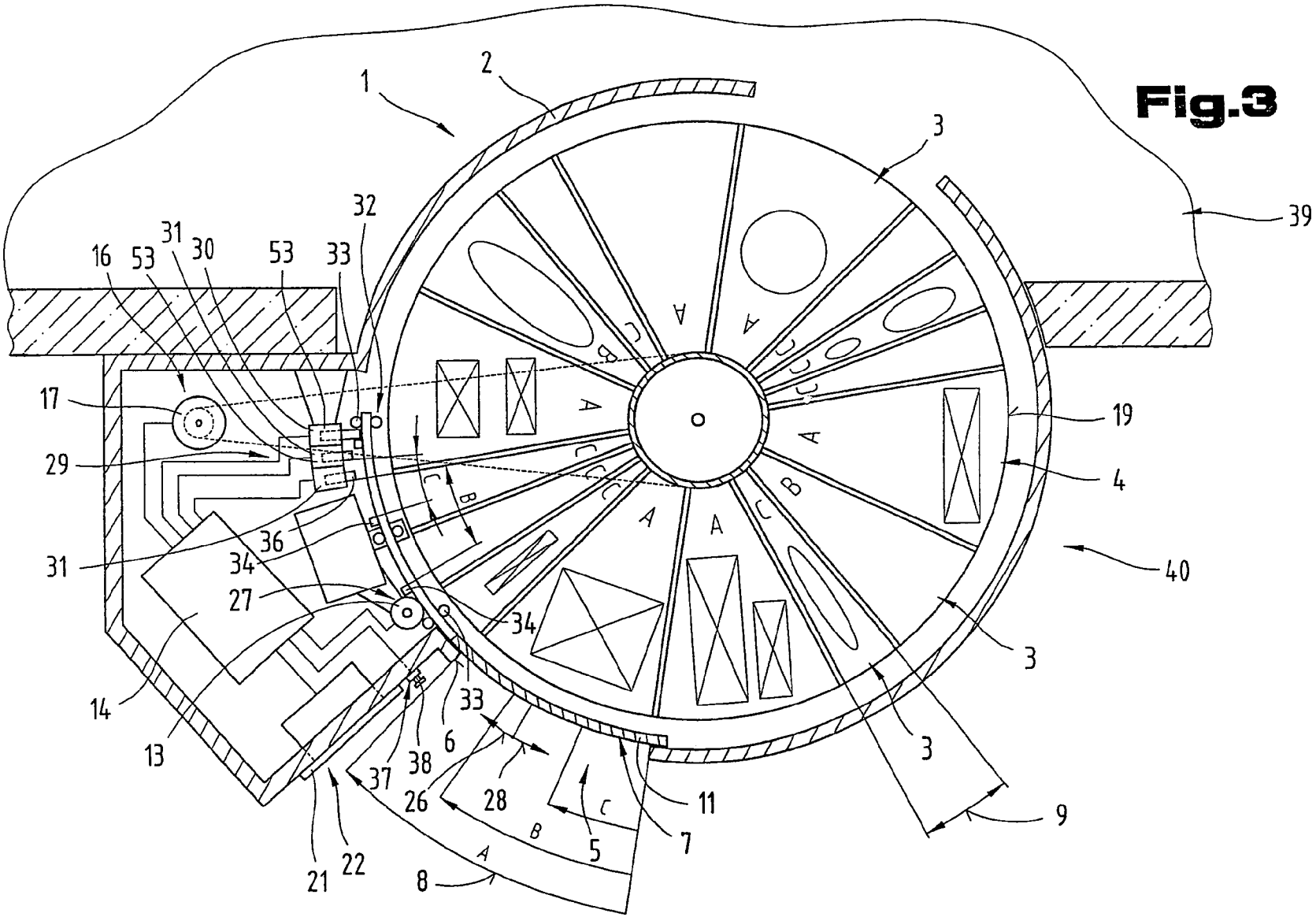
FIG. 3 is a simplified diagram in cross-section illustrating another embodiment of the storage machine.

FIG. 3 illustrates another embodiment of the storage machine 1, the same reference numbers being used for the same parts already described, in which case the descriptions given above can be literally applied to these same parts bearing the same reference numbers.

In this instance, several stop mechanisms 31 are provided for every closure mechanism 7 or every slide 11. In particular, the opening restriction 29 has several selectively activatable stop mechanisms 31. These stop mechanisms 31 may selectively activated or deactivated by the control system 14 and on the basis of its control commands. Activated or deactivated in this controlled manner, these stop mechanisms 31 for various stop positions 34 or different legitimate opening widths 12 are respectively connected to a control output of the control system 14. Accordingly, when a first or the uppermost one of the stop mechanisms 31 illustrated in FIG. 3 is activated, preferably by deactivating its power supply, the closure mechanism 7 is able to open at most by an amount corresponding to size C, thereby making a compartment 3 of size C accessible when the tumbler 30 is inactive. If, on the other hand, a second or the lowermost of the stop mechanisms 31 illustrated in FIG. 3 is activated, preferably by switching off or terminating its power supply, the closure mechanism 7 or slide 11 can be moved by a maximum amount corresponding to the distance B and a compartment 3 of size B positioned behind it or oriented flush with it can be filled or emptied—provided the tumbler 30 has been deactivated. If neither of the two stop mechanisms 31 is active, the closure mechanism 7 can be opened to the maximum width, in which case the compartment 3 of size A lying behind can be accessed if the tumbler 30 was deactivated by the control system beforehand.

The closure mechanism 7 is preferably opened via the drive system 13 but it may also be opened manually. Above all, the closing movements for the closure mechanism 7 are effected on an automated basis via the drive system 13.

In the embodiment illustrated, the first stop mechanism 31 constitutes a function pair with a corresponding stop position 34 or with a co-operating stop bar. The other or second stop mechanism 31 in conjunction with the appropriately designed strop bar disposed elsewhere also constitutes another function pair for producing the second stop position 34 for compartments 3 of size B.

Another option would be to provide only one stop mechanism 31 designed to operate several stop positions 34. This is primarily possible if the stop mechanism 31 or opening restriction 29 is operated on the basis of a timed and/or position-dependent activation by the control system 14. In particular, the stop mechanism 31 could be transferred or switched to specific relative positions with respect to the moving closure mechanism 7 at specific times, thereby ensuring a variably controlled fixing of the closure mechanism 7 at the maximum permissible open position or at the specific opening width 12.

The function of the tumbler 30 may optionally also be assumed by an activatable and deactivatable stop mechanism 31 on a timed or position-dependent basis—i.e. depending on the respective instantaneous position of the closure mechanism 7—as may be seen from FIG. 3. In other words, a stop mechanism 31 may also be provided for locking the closure mechanism 7 in its fully closed position, in which case it will be of a multi-functional design. By preference, however, a separate tumbler 30 is provided as a means of locking the closure mechanism 7 or slide 11 in the fully closed position.

In the embodiment illustrated, the guide mechanism 33 for the closure mechanism 7 comprises several rollers, which retain the closure mechanism 7 so that it is able to move along an arcuately curved guide track. The guide mechanism 33 for the closure mechanism 7 or slides 11 are designed so that a smooth, in particular manual displacement of the slides 11 is possible, even if relatively strong forces are directed towards the closure mechanism 7 perpendicular to the displacement plane. This ensures that even if a user applies a stronger force acting essentially perpendicular to the displacement of the closure mechanism 7 initiated automatically, the closure mechanism 7 or slides 11 can be easily displaced. This ensures that if a serious situation occurs, the closure mechanism 7 can be automatically opened or the movement can be automatically reversed or the user can be automatically freed from an individual access orifice 15 without difficulty as it closes.

In the embodiment illustrated in FIG. 3, an access orifice 6 which can be automatically closed and released in a controlled manner by the closure mechanism 7 is provided in the machine housing 2 of the storage machine 1, as well as an access orifice which can be overcome without an access check or access control. The unclosed or freely accessible access orifice is disposed in a protected or secured region or portion 39, to which only authorized persons have access, whereas the first access orifice 6 is assigned to a virtually public or generally accessible region or portion 40, and access is controlled by configuring the closure mechanism 7 to permit access to the respective compartment 3 or the respective object for authorized users only. In this connection, it is preferable not to opt for a fixed, predefined compartment allocation for specific persons but instead to operate the system on the basis of a free compartment allocation run from the control system 14. In other words, the compartments 3 are not allocated to a predefined, restricted circle of people or are not pre-reserved on a set basis, and instead the respective compartments 3 are allocated to a person who is in principle authorized or registered to use the machine, in particular a delivery service, via the local control system 14 and/or an external or central control center on a flexible basis as and when required. The registered or authorized persons will be persons delivering and/or collecting objects in particular.

In the embodiment illustrated in FIG. 3, a command input means 37 is provided, by means of which a close command can be initiated or a command to release or standby for a closing operation of the closure mechanism 7 can be forwarded or signaled to the control system 14. This command input means 37 is preferably provided in the form of what is referred to as an OK button 38, which, when manually operated by the user, indicates or signals to the control system 14 a state or readiness or a command for closing the closure mechanism 7 or respective slide 11. This OK button 38 is preferably disposed separately from the other input and/or output means 23 or separately from the other user-relevant command input means of the terminal 22. This OK button 38 is preferably of a highly reliable or high-security design, in particular with multiple electric circuits. It is also expedient to dispose the OK button 38 at a height on the machine housing 2 that is out of reach for children, in particular at a height of more than about 1 m above floor level.

When the control system is alerted to the fact that the operator has initiated or intends to issue a closure command via this preferably manually displaceable command input means 37 or by operating an OK button 38, the drive system 13 is firstly activated so that the closure mechanism 7 of the slide 11 is moved in the closing direction—indicated by arrow 28.

As illustrated in the embodiment shown in FIG. 3, a first part-portion of the storage machine 1 is disposed in a public or generally accessible portion 40, whereas another part-portion of the storage machine 1, in particular the rearward region of it, lies in a secured portion 39, to which only authorized or entitled persons have access. The separation between the public or generally accessible portion 40 and the access-protected portion 39 may be provided in the form of a diving wall, a building wall or some other partition.

Figure 4:
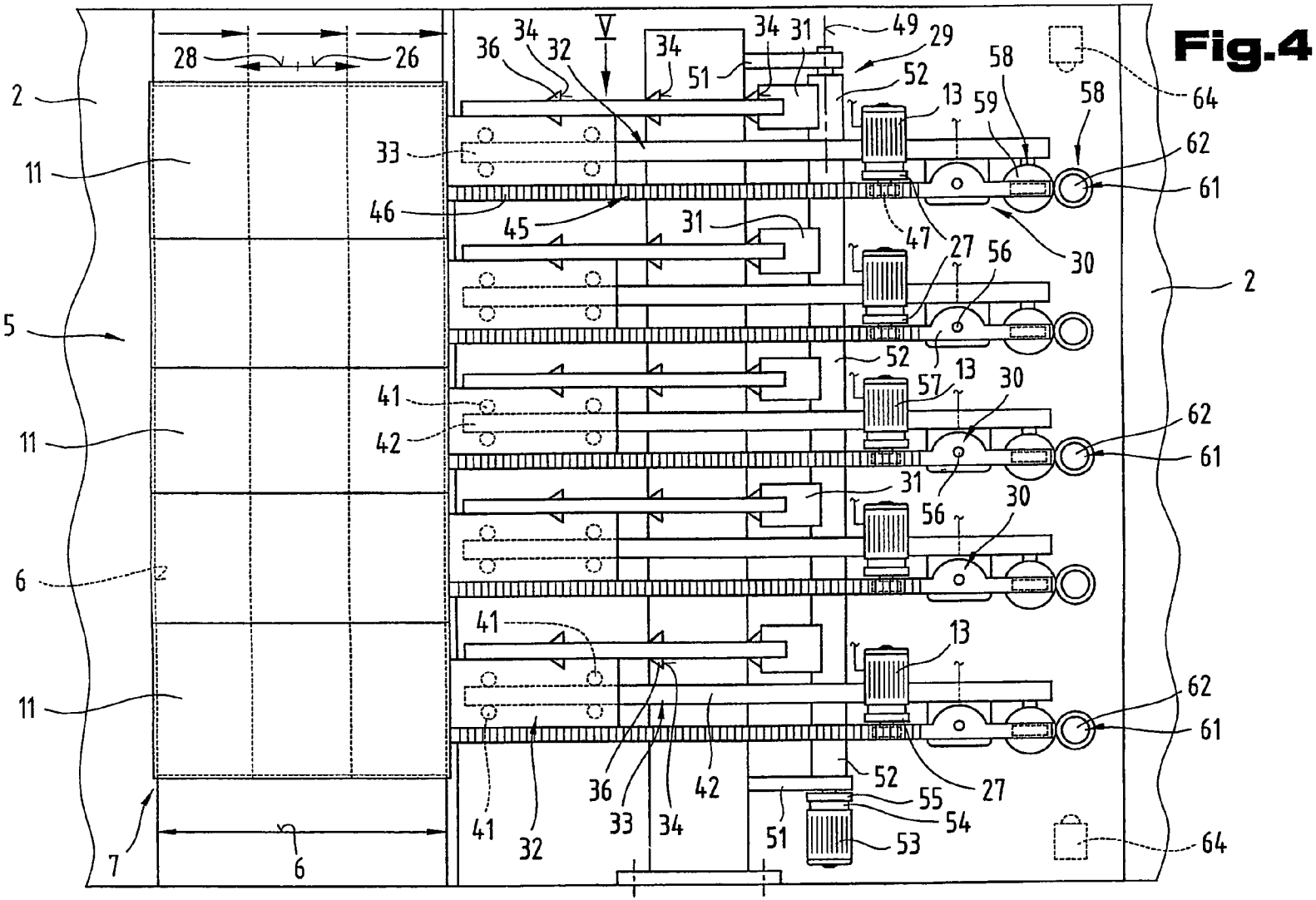
FIG. 4 is a simplified diagram illustrating one advantageous embodiment of the access mechanism for the storage machine, which can be controlled on an automated basis, viewed along line IV-IV indicated in FIG. 5.
Figure 5:
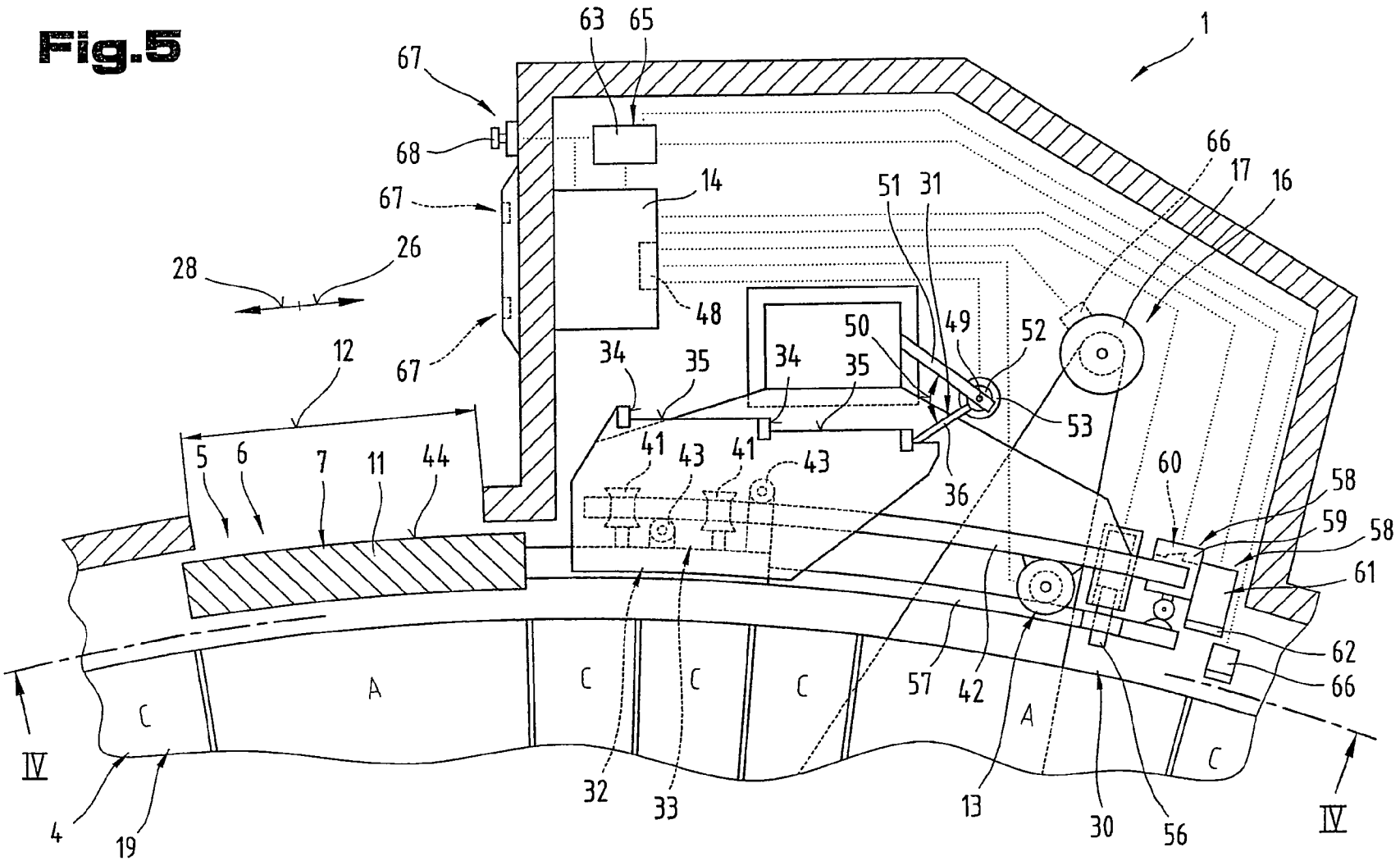
FIG. 5 is a simplified cross-section of the access mechanism and the storage machine illustrated in FIG. 4.
Figure 6:
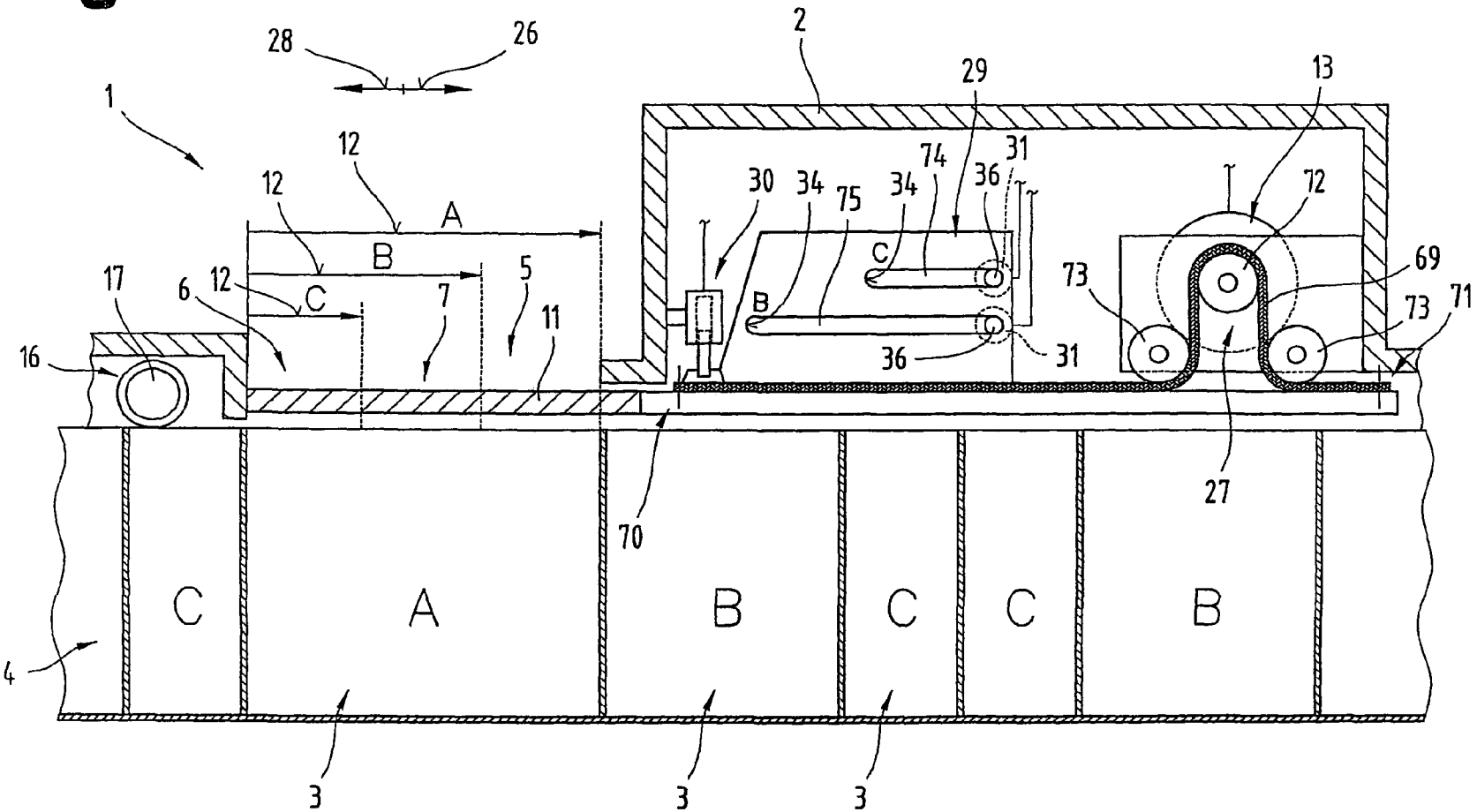

FIGS. 4 and 5 illustrate an advantageous embodiment of an automated or controllable access mechanism 5 for a storage machine 1 of the type schematically illustrated in FIGS. 1 to 3. This automated or controllable or automatically controllable access mechanism 5 comprises the closure mechanism 7 with a plurality of individually and selectively displaceable slides 11 disposed vertically one above the other. Each of the slides 11 is mounted so as to be displaceable in the horizontal direction by means of a respective co-operating bearing mechanism 32, in particular by means of a linear guide mechanism 33, by opening movements indicated by arrow 26, and closing movements indicated by arrow 28. The guide mechanism 33 comprises a plurality of rollers 41, which ensure that the slide 11 is retained in the vertical direction on the one hand and that the slide 11 is retained in the horizontal direction extending transversely to the sliding direction, on the other hand. The slide 11 is guided along an arcuately curved track, i.e. by means of a smooth roller guiding action. The rollers 41 may be provided in the form of track rollers, which are able to roll on an arcuately curved guide rail 42. These guide rollers secure the slides with the exception of a single remaining degree of freedom, thereby providing a stable bearing for the slides 11. Additional support rollers 43 are also provided, the axes of which extend perpendicular to the axes of the rollers 41 and which support and guide the slide 11 and prevent any inadmissible deflections in the direction perpendicular to an external or flat face 44 of the slide 11. The rollers 41 and the support rollers 43 of the guide mechanism 33 of the slide 11 oriented perpendicular to them ensure that even when external forces are acting on the slide 11 running essentially perpendicular to their displacement direction, the slide 11 is able to move as smoothly as possible without jamming.

The closure mechanism 7 or slides 11 are of an arcuately curved shape, in particular are at least approximately adapted to the external contour or radius of the round magazine 19.

Co-operating with each of the slides 11 is an electric motor-driven drive system 13. These drive systems 13 are hard-wired to the control system 14 and can be reversed in their directions of rotation by the control system 14 so that both an automated or automatic closing operation, indicated by arrow 28, and an automated or automatic opening operation, indicated by arrow 26, can be run. The movement between the drive system 13 and the closure mechanism 7 or the respective slides 11 is transmitted via a motion transmitting means 45 disposed between the slides 11 and the respective co-operating drive system 13 in each case. In the embodiment illustrated, the motion transmitting means 45 is provided in the form of a toothed rack 46, which is connected to the respective slide 11 on the one hand and in which toothed rack 46 a drive pinion 47 of the electric motor-driven drive system 13 engages on the other hand. The maximum driving force of the drive systems 13 may lie below a critical threshold value posing a risk of injury or danger on the one hand and/or the force or torque limiting device 27 is used in the drive train or in the movement transmission path between the drive system 13 and the closure mechanism 7 or respective slide 11 on the other hand, as schematically illustrated in FIG. 4. For example, the torce or torque limiting device 27 is provided in the form of a slip clutch in the region of the output of the drive system 13. As an alternative or in combination, however, an electromechanical power adjusting element 48 may also be provided, by means of which the driving force of the drive system 13 is reduced or can be reduced in a controlled manner. This electromechanical power adjusting element 48 may comprise a pulse width modulator, a variable frequency inverter or any other power or motor current limiting system. The power adjusting element 48 may co-operate with the control system 14 or be integrated in it but may also be disposed directly on the drive system 13.

In any event, the drive mechanism for the slide 11 is of a type which is not retained by friction, so that when the drive system 13 is inactive or in the event of specific mechanical defects, the slides 11 can be manually displaced, in which case a displacement can be effected by applying force in the displacement direction indicated by arrow 26 and/or arrow 28. However, it is also possible to stop or reverse the driving movement when the drive system 13 is active, because the closing or opening forces of the slides 11 are set low so that they can be applied or overcome by hand in order to stop or reverse the automatic movement of the slides 11. As explained above, the movement or driving force of the slides 11 can be limited on the one hand by the dimensioning of the drive system 13 and/or by incorporating force or torque limiting devices 27 in the transmission path or drive train between the drive system 13 and the slides 11 coupled with it in displacement. In particular, a defined, limited displacement coupling is disposed in the drive train between the drive system 13 and the slides 11 to be driven by it.

The opening restriction 29 for variably limiting the maximum opening width 12 of the slides 11 comprises a comb-type strip with several stages 35. These stages 35 in the comb-type strip thus constitute the different stop positions 34, which set the resultant limitation in the maximum possible opening width 12. The stop mechanism 31 in this example of an embodiment can be variably positioned. In particular, its stop element 36, which defines different stop positions 34 in co-operation with a stage 35, is mounted so that it can rotate or pivot. Specifically, the stop element 36 can be pivoted about an axis 49 so that different pivot angles can be assumed by reference to a horizontal plane. In particular, by increasing or reducing a pivot angle 50 between the pivotable stop element 36 and a retaining element 51 for the stop element 36, one of several possible stop positions 34 can be selectively activated. In other words, when the stop element 36 or the stop mechanism 31 assumes different pivot angles, a selection can be made from the respective stop positions 34 to be activated.

Based on the embodiment illustrated in FIG. 5, for example, if the pivot angle 50 is reduced, the slide 11 can be opened as a maximum so that it corresponds to a compartment size C. If the pivot angle 50 is reduced still further, the other stop position 34 comes into effect and the slide 11 can be moved so that it corresponds to the width of a compartment 3 of size A. In the position of the stop mechanism 31 or stop element 36 illustrated in FIG. 5, the slide 11 is prevented from moving, which means that in this position of the stop mechanism 31, a tumbler or locking action is produced for the slide 11, which totally pre-vents any movements, in particular opening movements.

As may best be seen from FIG. 4, every slide 11 is provided with an opening restriction 29. The individual stop mechanisms 31 for the individual slides 11 are coupled so that they move with one another, i.e. all the stop mechanisms 31 for the individual slides 11 are always in the same disposition or position. In the embodiment illustrated, the individual stop mechanisms 31 are disposed on a common support shaft 52, which is mounted so that it can be rotated about the axis 49. A common actuator drive 53 is provided for all the stop mechanisms 31, by means of which the different pivot angles 50 of the stop elements 36 can be assumed, so that the requisite stop positions 34 can be activated or enabled when the slide 11 is moved in the opening direction—indicated by arrow 26.

The system of positioning the stop mechanisms 31 in a controlled manner described above may incorporate a friction-retained gear system 54 in order to predefine the different stop positions 34 so that they can not be manually overcome. Alternatively or in combination, the stop mechanisms 31 may also be provided with a braking or blocking device 55, which can be automatically activated depending on the maximum permissible opening width 12 or positioning width for the closure mechanism 7 or slides 11, which reliably presents a displacement of the actuator drive 53 or stop mechanism 31 once the specified actuation position is assumed. In particular, the braking or retaining force of the actuator drive 53 or its braking or blocking device 55 is dimensioned so that it can not be overcome by hand and thus reliably prevents any unacceptable widening of the individual access orifices 15.

By preference, the tumbler 30 is also provided in this instance, which causes a blocking or locking of the slides 11 preventing all movement when in the activated state. In the embodiment illustrated as an example, the tumbler 30 is provided in the form of an electromagnetically displaceable actuator part 56, which can be moved into and out of a positive engagement with the slide 11 or a coupling element 57 secured to the slide 11 in a controlled manner. In the active position illustrated in FIGS. 4 and 5, the actuator part 56 extends through the coupling element 57, thereby preventing any movement of the slide 11 in the directions indicated by arrow 26 or by arrow 28. When the tumbler 30 is in the active state, it is preferably without current and no external power is supplied to the tumbler 30. If the tumbler 30 has to be deactivated because the respective slide 11 is required to assume a predefined position, electrical power is applied to the tumbler 30, in particular the tie rod magnet, so that the actuator part 56 moves out of engagement with the coupling element 57 on the slide 11, thereby enabling a displacement of the slide 11 as far as the corresponding, predefined stop position 34. In this connection, it should be pointed out that the control system 14 selectively deactivates only that tumbler 30 with respect to which a displacement is necessary in the opening direction—indicated by arrow 26. All the other tumblers 30 for the slides 11 which do not have to be opened remain activated as before, i.e. remain in their non-operating position without power or current, as illustrated in FIG. 5.

Also with the embodiment illustrated in FIGS. 4 and 5, a control device 58 is provided, by means of which an open or closed state of the closure mechanism 7 or of every individual slide 11 can be detected. In the embodiment illustrated, the control device 58 has at least one electromechanical switch 59, which signals the fully closed position of the closure mechanism 7 or respective slide 11. By preference, the switch 59 has at least one control contact 60, which is able to detect when a slide 11 is fully closed and when it is locked or completely open or unlocked via the tumbler 30. Accordingly, the control contact 60 may be provided in the form of an electric closing or opening contact, in which case one of the switch states signals a fully closed position, of the respective associated slide 11, preferably locked by the tumbler 30, to the control system 14. The control device 58 is preferably of the type with two circuits or two channels, thereby resulting in a failsafe system. In other words, if the signals of the two-circuit control device 58 do not match, the control system 14 detects an invalid operating state or error and then signals a fault or prompts a status control. To this end, the control device 58 may be provided with an additional, separate switch 59 or another sensor-based detection system 61 of another physical design or operating mode. In particular, the detection system 61 of the two-circuit control device 58 may be provided in the form of an inductive sensor 62, which detects the relative position of the slide 11 with respect to the access orifice 6. This detection system 61 or the switch 59 is preferably disposed so that whenever the slide 11 is in the fully closed position, there is no detectable metal element in its detection range which can be detected by the inductive sensor 62. The signals of the second control device 58 or the detection system 61 are preferably evaluated by a separated evaluation device 63 or by a control system which is independent of the control system 14. In situations where the detection signals of the first and second control device 58 match, a basic criterion for switching on the transport mechanism 16 is satisfied. Especially if the evaluation device 63 of the control system 14 signals that a fully closed closure mechanism 7 was detected by the second control device 58, and on condition that the detection results of the first control device 58 confirm that this is the case, the drive unit 17 can be activated by the control system 14 if this is necessary for the subsequent operating sequence of the storage machine 1. If, on the other hand, one of the two control devices 58 signals that one of the slides 11 is not in the fully closed position, the transport mechanism 16 or the drive unit 17 is not automatically activated under any circumstances. This ensures that the compartment system 4 is not moved or displaced, in particular rotated, until access to the compartment system 4 is impossible because all the slides 11 are in the fully closed position, thereby preventing access to a compartment system 4 which might suddenly be set in motion. This virtually rules out any chance of injury to the operator of the storage machine 1 due to automatically moving parts. The two-circuit detection system and the preferably independent evaluation of the signals of the two control devices 58 for detecting and monitoring the closed position of the slides 11 thus increase the safety and functional reliability of the storage machine 1 to a particularly high degree. In other words, the control device 58 respectively the control device 58 of a parallel or two-circuit design, emits a release signal when the closure mechanism 7 is fully closed, in particular only if all the slides 11 are fully closed and the closure mechanism 7 or slides 11 are additionally in a mechanically locked state, which indicates to the control system 14 that the transport mechanism 16 for the compartment system 4 can be activated if necessary, without there being any risk to a user, once the access mechanism 5 has prevented all access to the compartment system 4.

The control device 58 or the control device 58 based on a parallel design preferably also releases the power supply to drive the transport mechanism 16 if the control result is positive in addition and does so independently of the control system 14.

A check is preferably also run via the two-channel control device 58 to ascertain whether the tumbler 30 is active for a fully closed closure mechanism 7 or for the slides 11. The tumbler 30 is configured so that in the powerless state, in other words when electric power is not being applied, the respective slide 11 is locked or blocked.

It is also of advantage if an active state or locked state of the tumblers 30 is run by means of an attempt to open the closure mechanism 7 or slide 11 via the respective drive system 13. This being the case, an attempt is made by the control system 14 to move the closure mechanism 7 or slide 11 by a few millimeters by means of the drive system 13. If the tumbler 30 is in the locked position or active, this will stop the attempt to effect a movement by a few millimeters. If, after such a minimal attempt to effect a movement, the control device 58 continues to detect a closed closure mechanism 7 or closed slide 11, it will be assumed by the control system 14 that the tumblers 30 are active and similar manual attempts to effect any movement will be mechanically prevented. Optionally, the control system 14 may also use a response signal or step signal from the drive systems 13 to reach a conclusion as to whether the tumblers 30 are active or inactive.

The control device 58 may also optionally be provided in the form of at least one photoelectric barrier system 64, as indicated by broken lines. A control device 58 of this type is perfectly suitable for monitoring or detecting the disposition or position of a plurality of closure mechanisms 7 or slides 11 in their closed state. In particular, if one of the slides 11 is slightly open it will interrupt the light beam of the photoelectric barrier system 64, as a result of which the control device 58 will not authorize activation of the transport mechanism 16. If the photoelectric barrier system 64 is interrupted because one of the closure mechanisms 7 is not in the fully closed position, i.e. a light beam of the photoelectric barrier system 64, the transmission system between transmitter and receiver can not be overcome. The photoelectric barrier system 64 may then operate on the reflection principle, whereby transmitter and receiver units for the light beam are disposed directly adjacent to one another, or on the beam principle, whereby the area between the transmitter and receiver units constitutes the detection zone.

As may also be seen from FIG. 5, the storage machine 1 may also have a motion monitoring system 65. The purpose of this motion monitoring system 65 is to detect whether the compartment system 4 or at least one of the compartments 3 is moving or stationary. The motion monitoring system 65 has at least one transmitter or sensor 66, by means of which a movement or lack of movement of the compartment system 4 can be electromechanically detected and evaluated. This being the case, this sensor 66 may be positioned in the region of the compartment system 4 and/or co-operate with the transport mechanism 16 or drive unit 17 for the compartment system 4, as indicated by broken lines in FIG. 5. In particular, the sensor 66 of the motion monitoring system 65 may be provided in the form of a transmitter which detects rotating movements of the drive unit 17 or alternatively may co-operate with the movement transmitting element such as a drive chain, a ring gear or similar.

The at least one sensor 66 is connected to an input of at least one electronic evaluation circuit. In particular, the sensor 66 is hard-wired to the control system 14. Alternatively or in combination, the sensor 66 of the motion monitoring system 65 may be connected to a separate, independently operating evaluation device 63, thereby ensuring the highest possible evaluation reliability of the sensor signals. If the evaluation device 63 or control system 14 detects via the relevant motion monitoring system 65 that at least the drive system 17 but preferably the compartment system 4 itself is stationary, a first condition for an opening operation of the closure mechanism 7 or at least one of the slides 11 is satisfied. If, on the other hand, it is detected via the motion monitoring system 65 that the compartment system 4 is moving, the closure mechanism 7 is not opened as a matter of principle and the closure mechanism 7 or a slide 11 can also not be opened by hand. The sensor signals are preferably evaluated independently of the control system 14 for the drive unit 17 and the motion monitoring system 65 is preferably of a two-circuit or failsafe design. In other words, the motion monitoring system 65 is preferably configured independently and separately from the local, actual control system 14 of the storage machine 1 and independently of the system controlling the transport mechanism 16.

The control device 58 for monitoring or detecting the closed state of the closure mechanism 7 is preferably also configured independently of or separately from the actual control system 14 of the storage machine 1.

In another advantageous embodiment, a bridging device 67 may also be provided for functionally bridging or temporarily deactivating the control device 58. In particular, if the bridging device 67 is activated consciously or by the user even though the closure mechanism 7 is open or partially open, the compartment system 4 will move. The bridging device 67 can only be activated by authorized and experienced persons, such as commercial delivery service personnel or service engineers, for example. The bridging device 67 preferably has an OK button 68, which is then actively operated by an operator of the storage machine 1 and held in the operating position if the control device 58 needs to be temporarily deactivated. The bridging device 67 or the OK button 68 has a key switch function, i.e. functional bridging of the control device 58 is only active as long as the OK button 68 is operated by the operator of the storage machine 1 in a specific way.

The OK button 68 is preferably provided in the form of a two-stage and optionally also as a three-stage button. Accordingly, in one predefined operating position, the control system 14 indicates the confirmation to activate or operate the transport mechanism 16 and the movement of the compartment system 4, even though the closure mechanism 7 or at least one of the slides 11 is open or partially open. When the OK button 68 is in the non-operated state and also in a third switching stage with which the OK button 68 may optionally be provided, no authorization is given for a movement of the compartment system 4 when the closure mechanism 7 is open, which means that a movement of the compartment system 4 can be ruled out or prevented with a high degree of reliability. The third switching stage of the OK button 68 provided as an option corresponds to a so-called panic position of the OK button 68, in which the transport mechanism 16 or the compartment system 4 is stopped, in which case a braking or blocking device is activated in order to switch to the stationary position immediately. The panic position is assumed in particular when the OK button 68 is depressed to the third switching stage. The second and third switching stages are initiated by repeatedly depressing the OK button 68 or increasing pressure on it to indicate panic.

However, the bridging device 67 may be provided in the form of two buttons spaced at a distance apart from one another, as indicated by broken lines in FIG. 5. In particular, these buttons are positioned in such a way that the user will need both hands to operate the buttons simultaneously, in which case there will be no possibility of leaning into the danger area or of other limbs being placed in the danger area or open access orifice 6.

The transport mechanism 16 is preferably driven at a slower speed when the bridging device 67 is activated, so that the risk of injury to a user due to the moving compartment system 4 and the at least partially or totally open closure mechanism 7 is less likely and the user as well as the drive systems involved have a slightly longer reaction time in the event of danger. The bridging device 67 is preferably activated by specifically trained, experienced operating personnel, in particular a delivery service employee or distributor of objects. Amongst other things, the advantage of this bridging device 67 resides in the fact that a plurality of objects can be placed in the various compartments 3 easily and relatively quickly because there is no need to open and close the closure mechanism 7 or the respective slides 11 constantly in order to deposit objects.

FIGS. 6 to 10 illustrate other possible embodiments of the variable, controllable opening restriction 29 and for the drive of the closure mechanism 7 or slides 11. The descriptions given above apply to identical parts denoted by the same reference numbers.

The drive system 13 for the closure mechanism 7 based on a limited force or torque has a belt-type, flexible but largely compression-resistant and tension-resisting motion transmitting means 69 between the drive system 13 and the closure mechanism 7 or the associated slide 11. The motion transmitting means 69, e.g. in the form of an endless V-belt or cogged belt, is joined by its two ends 70, 71 to the slide 11 so as to move with it or is attached thereto. The portion of the belt-type motion transmitting means 69 disposed in between is fed round a driving pulley 72, and a sufficient looping angle is produced on the driving pulley 72 via at least one guide pulley 73 for the belt-type motion transmitting means 69. When the driving pulley 72 is actively rotating, it imparts a linear movement to the slide 11. In the preferred embodiment of a drive system 13 which can be controlled so as to reverse its direction of rotation, it is possible to effect automated opening movements—indicated by arrow 26—and closing movements—indicated by arrow 28.

It is also preferable to provide a tumbler 30 which can be activated and deactivated and which is prevented from opening reliably and with a high degree of stability when the slide 11 is fully closed.

The opening restriction 29 for automatically limiting or setting different, maximum permissible opening positions of the closure mechanism 7 or slide 11 depending on the size of the specific compartment 3A, 3B or 3C in this instance has several, in particular two stop mechanisms 31 which can be activated and deactivated in a controlled manner in order to produce different stop positions 34 or opening widths 12B, 12C. This being the case, the electrically controllable stop mechanisms 31 may easily be provided in the form of tie rod magnets, the stop elements 36 of which can be moved into and out of engagement with a groove-shaped or slot-shaped restrictor element 74, 75. In particular, if operating with two possible, different stop positions 34, two slot-type or slit-type restrictor elements 74, 75 of differing length are provided. Accordingly, when the first stop mechanism 31 is active, i.e. its stop element 36 is inserted in the restrictor element 74, a displacement of the slide 11 or opening thereof is possible at most by a distance C, so that a compartment 3 of size C is made accessible. If, on the other hand, the first stop mechanism 31 is deactivated, preferably by applying electric power to it, the other, still active stop mechanism 31 comes into play so that the slide 11 can be pushed or opened at most by a distance B and a compartment 3 of size B can then be accessed or a compartment 3 of size B is accessible.

If, on the other hand, both stop mechanisms 31 are inactive, in which case their stop elements 36 are moved out of the slot-type restrictor element 74, 75, the slide 11 can be moved accordingly by the distance A and thus the maximum opening width 12 can be obtained so that a compartment 3 corresponding to size A, can be accessed, in other words the biggest or widest compartment 3, if one has been positioned behind the access orifice 6 by the control system 14 via the transport mechanism—as illustrated in FIG. 5 for example. The positioning of the differently sized compartments 3 or specifically intended compartments 3, i.e. those compartments 3 designated for controlled access out of a plurality of compartments 3 of the compartment system 4, is therefore effected via the controllable transport mechanism 16.

The stop mechanisms 31 are preferably active in the state without power or current, i.e. their stop elements 36 are positioned so that they are actively able to interact with the respect co-operating stop position 34.

The mechanical force or torque limiting device 27 in this instance is provided in the form of a friction drive, i.e. the force is restricted by a defined frictional connection between the driving pulley 72 and the belt-type motion transmitting means 69. Alternatively or in combination, however, the maximum output of the drive system 13, in particular the drive motor, may be dimensioned so that the driving force or driving power to be applied to the slides 11 is below a critical threshold value pertaining to risk of injury or danger. It is preferable to use torque limiting systems or slip clutches that induce as little wear as possible and require no maintenance for long periods.

Figure 7:
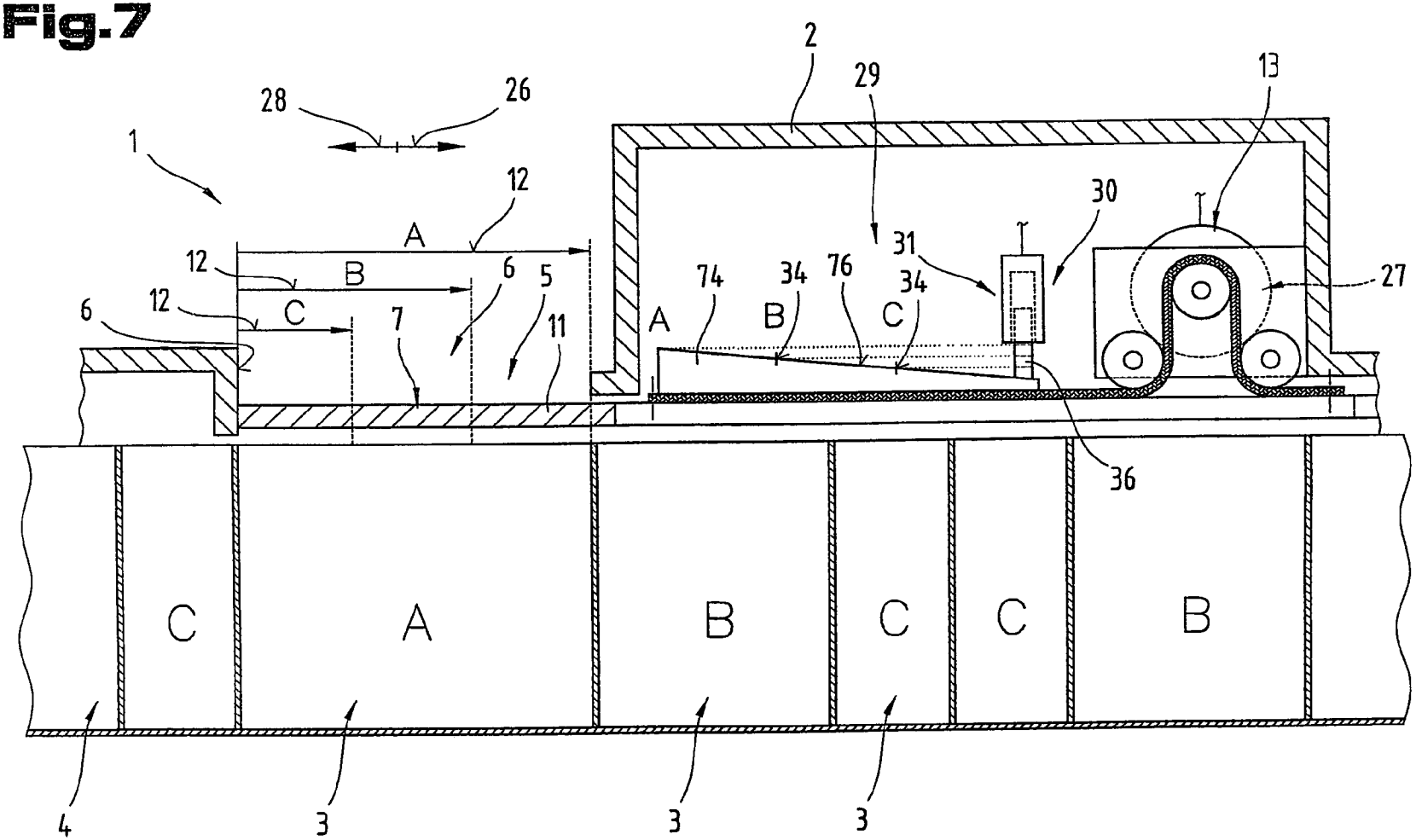

FIG. 7 illustrates a different embodiment of an opening restriction 29. In this instance, a stop mechanism 31 which can be variably positioned in a controlled manner is provided, the bolt-type stop element 36 of which can be moved into different positions in a controlled manner. Once the different positions are assumed, the stop element 36 is rigidly secured and positioned so that it is not able to move. This stop element 36 likewise co-operates with at least one restrictor element 74. In particular, the restrictor element 74 is coupled with the slide 11 in displacement or attached to it and is of a wedge-shaped or oblique design by reference to the direction of movement of the slide 11—indicated by arrow 26 or indicated by arrow 28. An oblique surface 76 of the wedge-shaped restrictor element 74 is directed towards the stop element 36 which can variably positioned in a controlled manner. The restrictor element 74 and the controlled, displaceable stop mechanism 31 co-operate in such a way that when the slide 11 is being opened—as indicated by arrow 26—a clearance distance between the oblique surface 76 and the stop element 36 becomes smaller until finally the oblique surface 76 lies against the stop element 36 and any further slide movement in the opening direction—indicated by arrow 26—is prevented by the abutment. The different positions A, B, C which can be assumed and then correspond to the individual opening widths 12A, 12B, 12C are clearly illustrated in FIG. 7.

The stop mechanism 31 may optionally also assume the function of the tumbler 30 described above. This being the case, the stop element 36 prevents the slide 11 from opening from its fully closed position illustrated in FIG. 7. As also illustrated, the stop element 36 of this stop mechanism 31 is also used to restrict the maximum opening width 12A, i.e. another stop or a stop mechanism 31 is provided, which terminates or restricts the movement of the slide 11 at its maximum opening position.

Figure 8:
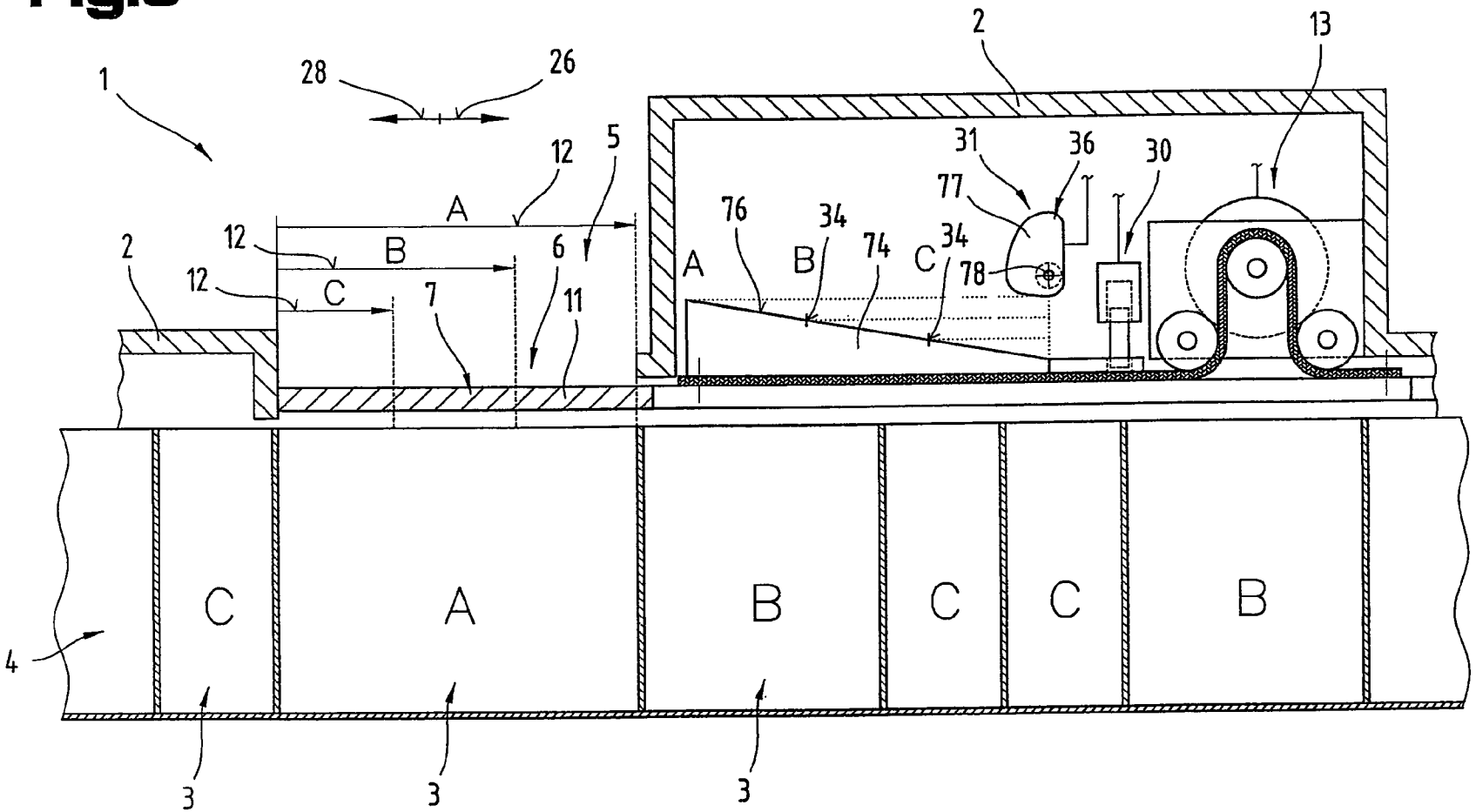

In the case of the embodiment illustrated in FIG. 8, the stop mechanism 31 has a so-called cam plate or eccentric plate 77 as its variably positioned stop element 36. This eccentric plate 77 is mounted so as to be displaceable about a rotation axis 78 and has regions of increasing or varying radius by reference to this rotation axis 78. Depending on the angular position of this eccentric plate 77, therefore, a clearance distance between an oblique surface 76 of an oblique restrictor element 74 and the eccentric plate 77 can be varied. As a result, the maximum available opening distance of the slide or slides 11 can in turn be restricted, as clearly illustrated in FIG. 8. By dimensioning the pitch accordingly and providing adequate pitch ratios between the control curves of the eccentric plate 77 and the restrictor element 74, the locking action can be applied so that it automatically increases or is self-inhibiting. Optionally, the block on movements between the restrictor element 74 and eccentric plate 77 may be further enhanced by toothing on the oblique surface 76 and/or the eccentric plate 77, thereby reliably preventing any undesired movements.

Here too, the function of the tumbler 30 may optionally be assumed by the stop mechanism 31 or eccentric plate 77. However, it is preferable to provide a separate tumbler 30, thereby ensuring a highly reliable lock and resulting in a tamperproof fixing of the slide 11 in the fully closed position.

Figure 9:
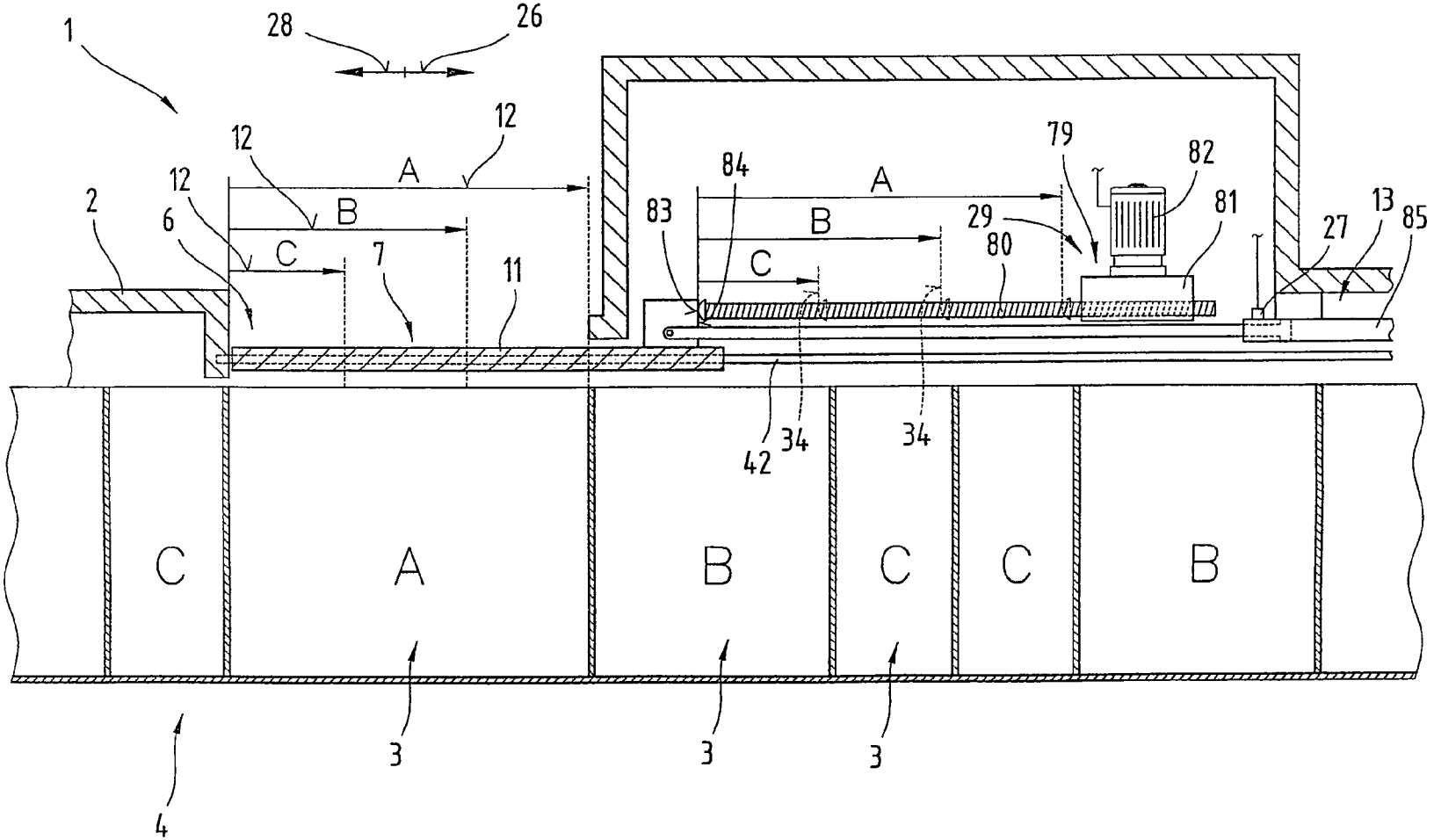

FIG. 9 illustrates another possible embodiment of an opening restriction 29 for variably restricting the maximum opening width 12A, 12B, 12C of a closure mechanism 7 or a linearly displaceable slide 11 in a controlled manner. The stop mechanism 31 of this opening restriction 29 comprises a threaded spindle arrangement 79 which can be variably positioned in a controlled manner. The respective stop positions 34 needed to restrict the opening widths 12A, 12B, 12C in this instance are obtained on the basis of different positions of the threaded spindle arrangement 79. In particular, a threaded spindle 80 can be automatically moved relative to a fixedly mounted spindle bearing 81. In order to produce a relative movement of the threaded spindle 80 with respect to the spindle bearing 81, a controllable electric motor-driven drive 82 is provided. Based on the number of revolutions of the threaded spindle 80 or the drive 82 relative to the spindle bearing 81, its actuator position can be varied or changed in a controlled manner depending on the requisite or maximum permissible opening width 12A, 12B, 12C. A terminal end 83 of the threaded spindle 80 or a terminal fitted part can then interact with a stop surface 84 on the slide 11 in order to set the various stop positions 34.

The drive system 13 used to produce the relative movement of the closure mechanism 7 or slide 11 relative to the access orifice 6 at the housing end or integrated in the housing in this instance is a piston-cylinder arrangement 85. The positioning force or power which can be achieved by means of this piston-cylinder arrangement 85 is specifically influenced by the working or operating pressure of the liquid or gaseous driving medium, which may be oil or air, for example. This piston-cylinder arrangement 85 co-operates with a pump system or pressure storage system for applying the limited working pressure, although this is not illustrated. In order to limit the working pressure or driving force of the piston-cylinder arrangement 85, however, it would also be possible to use over-pressure valves or throttles which then serve as the force or torque limiting device 27. This drive system 13, in particular the power or driving force of the piston-cylinder arrangement 85, is therefore also selected so that serious injuries to a user due to movements of the slide 11 or due to other movements of a closure mechanism 7 can be virtually ruled out.

As may also be seen from FIG. 9, the slide 11 has with a straight or arcuately curved guide rail 42, which co-operates with the top and/or bottom edge of the individual slides 11, thereby providing a robust and wear-free guiding action. These guide rails 42 are preferably disposed congruently with the compartment bases or the individual compartment levels, so that there are virtually no obstructions with regard to accessibility of the compartments 3. A sufficiently stable bearing of the slide 11 can also be obtained if the guide rails 42 do not extend into the region of the access orifice 6 but run only in the interior of the machine housing 2 so that they are not accessible to a general machine user.

Figure 10:
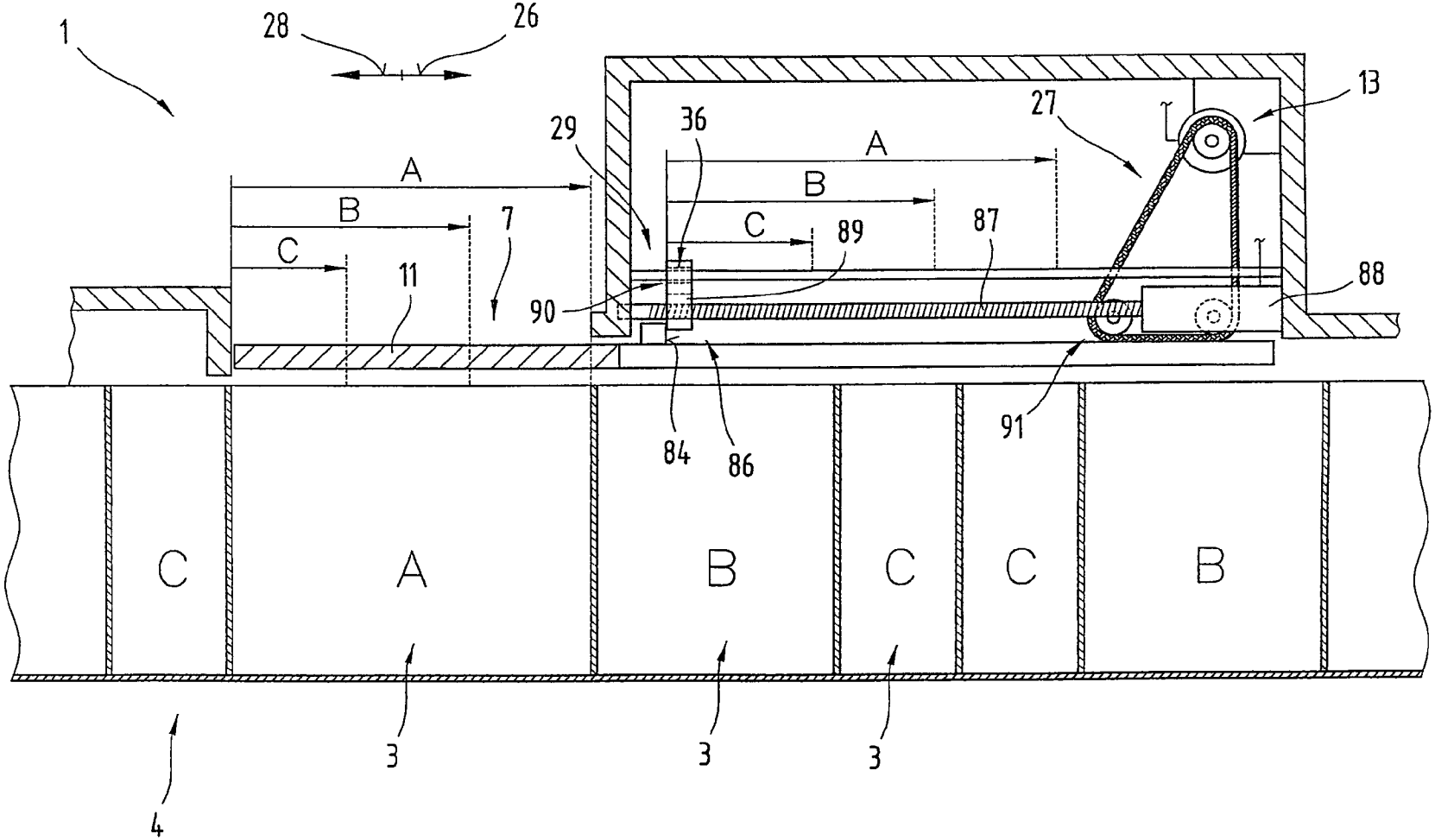

FIG. 10 illustrates other embodiments of an opening restriction 29 and a system 13 with restricted force for the closure mechanism 7 and the at least one slide 11 of the storage machine 1.

The opening restriction 29 in this case is a so-called moving nut arrangement 86. This moving nut arrangement 86 has a threaded spindle 87, which can be moved in a direction of rotation about its longitudinal axis by means of a controllable drive 88. Mounted or screwed onto this threaded spindle 87, which can be controlled on the basis of its direction of rotation and the number of rotations, is at least one threaded nut 89. When the threaded spindle 87 is rotated by means of the drive 88, the threaded nut 89 assumes different relative positions with respect to the longitudinal direction of the threaded spindle 87 and with respect to the drive 88. The threaded nut 89 or an element attached to it therefore acts as a stop element 36 which can be variably positioned for a stop surface 84 on the slide 11 or on the closure mechanism 7. As schematically illustrated, the threaded nut 89 may also cooperate with a slide guide element 90 in order to prevent the threaded nut 89 from rotting and ensure that it is able to move longitudinally along the threaded spindle 87.

Based on an expedient choice of thread pitch, in particular by using relatively flat thread pitches, the moving nut arrangement 86 may be designed to act due to frictional hold, i.e. it remains in a stable position and is prevented from turning even if strong forces occur parallel with the longitudinal axis of the threaded spindle 87.

The driving force of the drive system 13 is limited by means of a mechanical, force or torque limiting device 27 in this instance, which comprises a friction drive 91, for example a drive with a driving wheel or a frictionally acting belt drive. This ensures that only a limited or defined amount of force is transmitted in order to move the automatically displaceable slide 11, and this force is dimensioned so that serious injuries to a user can be ruled out. The force or torque limiting device 27 may also be based on any electric or mechanical throttle systems or limiting systems known from the prior art. In particular, a centrifugal coupling may also be used as the coupling imparting movement between the between drive system 13 and closure mechanism 7, which ensures full uncoupling when the drive system 13 is stationary or operating at low speed as well as a low force or torque transmission. Another advantage of this mechanically non-rigid displacement coupling using a centrifugal coupling is the soft, gentle initial motion of the displacements of the of the closure mechanism 7.

It would also be possible for the force or torque limiting device 27 to be a coupling which disengages when the drive connection reaches a threshold value. An overload coupling of this type might have spring-biased driver pins or coupling pins, for example, or operate on the principle of friction between a driving and a driven functional element.

As a slip clutch or torque limiting device, it would also be possible to use spring-biased spheres or spherical portions, which establish a connection with a limited torque between two non-positively coupled motion transmitting parts in the drive train between the automatically controlled drive system 13 and the closure mechanism 7 or at least one of the slides 11.

Another option is to use a coupling mechanism whereby when an overload occurs, for example due to a blocking of the movement of the closure mechanism 7 due to objects or limbs of the user, the drive connection is completely interrupted. A coupling mechanism which is temporarily released in the event of overload can be consciously and easily reinstated or re-established by a manual pushing action as far as or close to the stop limiting system, for example, and/or by a manual pushing action in the closing direction—arrow 28. In particular, an overload coupling of this type is reversible so that in the event of release, the coupling connection can be easily restored, preferably by a generally untrained machine operator.

Figure 11:
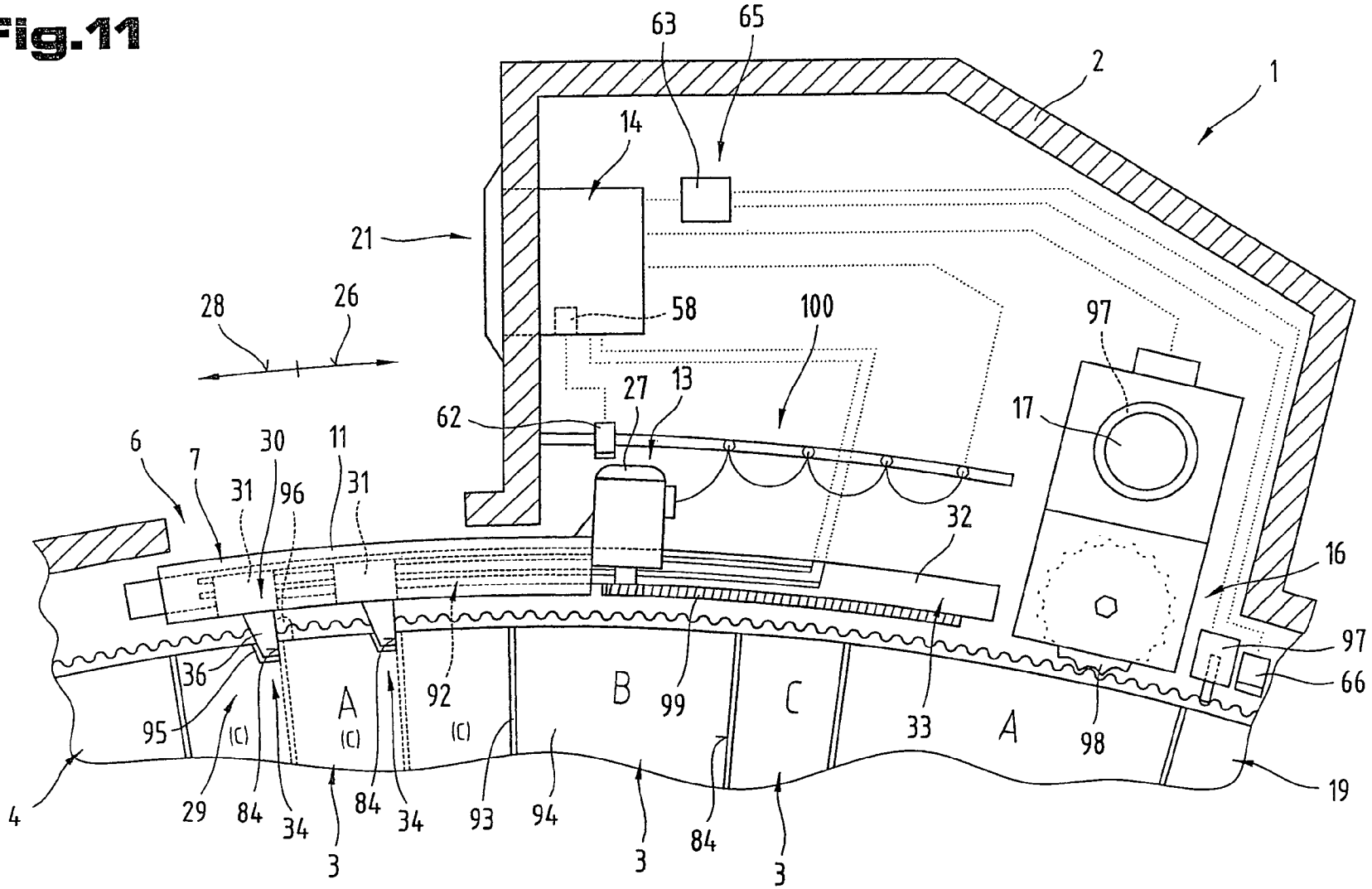

FIG. 11 illustrates another embodiment of an opening restriction 29, a drive system 13 and a transport mechanism 16 for a storage machine 1.

The opening restriction 29 for the closure mechanism 7 or at least one of the slides 11 is provided in the form of at least one stop mechanism 31, which can be activated and deactivated on a controlled basis, and which is disposed directly on or in the relatively displaceable closure mechanism 7 or respectively on the slides 11 provided. Parts or part-portions of the at least one stop mechanism 31 are therefore integrated in the body of the closure mechanism 7 or the slide 11. The at least one stop element 36 of the stop mechanism 31 can be moved in a controlled manner relative to the internal face of the closure mechanism 7 or slide 11. In particular, the stop element 36 can be extracted or inserted or pivoted out and in relative to the internal face and/or an end face of the closure mechanism 7.

To this end, the at least one stop element 31 is actively connected to the control system 14, in particular is hard wired. In the transition region between the bearing mechanism 32 or guide mechanism 33 and the closure mechanism 7, at least one slide contact arrangement 92 for transmitting power and signals to the controllable stop mechanism 31 may be provided. Via it, driving power and/or control signals can be transmitted between the control system 14 and the at least one stop mechanism 31. This being the case, this transmission may also take place when the closure mechanism 7 or slide 11 is in relative movement with respect to the stationary access orifice 6 on the housing. Instead of such a slide contact arrangement 92, it would also be possible to use a contactless, in particular inductive signal and power transmission system between the stop mechanism 31 and a stationary, co-operating transmitter and/or receiver unit for electric power and/or signals. It would also be conceivable to use a trailing cable arrangement for the power and signal transmission between the slide-end stop mechanisms 31 and the control system 14 controlling it and supplying it with power.

The at least one stop mechanism 31 in this instance interacts with the compartment system 4. In particular, the stop mechanism 31 for limiting the slide distance or limiting the opening width by reference to the requisite access dimensions of the compartment 3 to be released can be moved into and out of engagement or based on a stop effect with respect to a mechanical component of the compartment system 4 in a controlled manner. This being the case, the mechanical stop part of the compartment system 4 may be a compartment dividing wall 93 and/or a compartment base 94 of the compartment system 4. In particular, stop surfaces 84 are provided on the compartment system 4 due to recesses 95 in the compartment base 94 and/or by providing projections 96 on the compartment base 94, indicated by broken lines, or on at least one compartment dividing wall 93 and/or may be formed by the compartment dividing wall 93 itself. The compartment system 4 can be secured so that it can not move or is rendered rigid by means of the transport mechanism 16 itself and/or via a separate or additional braking and/or blocking device 97 at the respective stationary position or at the respective relative position with respect to the machine housing 2 or access orifice 6. Due to a mechanical interaction, which is restricted by a stop, between the compartment system 4 and at least one slide-end stop mechanism 31, the respective legitimate opening width or access dimensions which are needed can be restricted on a controlled basis and regulated. This is done by selectively activating or deactivating the stop elements 36 via the control system 14 at the respective relative positions with respect to the compartment system 4. In other words, the maximum permissible opening width is limited by activating the stop mechanism 31 at the respective point in time and at the respective relative position with respect to the compartment system 4 via the control system 14 so that any further movement or opening of the slide 11 at the respective stop positions 34 corresponding to the various compartment sizes is prevented.

The transport mechanism 16, in particular the drive unit 17, may have an integrated braking and/or blocking device 97, for example a rotor brake or cone brake, for example, in order to bring the compartment system 4 to a standstill and hold it with a strong retaining force. Accordingly, the braking and/or blocking device 97 is provided in the form of a cone brake on a rotor or electric motor spring-biased in the axial direction, preferably on the drive unit 17, as schematically indicated. However, the braking and/or blocking device 97 may also co-operate with the compartment system 4 itself or its mechanical components and is provided in the form of a controllable bolt or pawl lock, as also schematically indicated in FIG. 11. This braking and/or blocking device 97 for the compartment system 4 is preferably of a type which can be electrically controlled, in particular without actively supply external energy, and can be deactivated by supplying energy in a controlled manner. The braking and/or blocking device 97 is used as a means of rapidly terminating and/or reliably blocking movements.

Alternatively, the transport mechanism 16 which can be activated by the control system 14 may also have a gear system retained by friction, for example a so-called worm gear. A brake mechanism may also act on the external circumference of the compartment system 4, in particular on a casing circumferential surface or a brake surface on the round magazine 19. Instead of a chain connection or a chain drive between the transport mechanism 16 and the compartment system 4 to be moved relative to the machine housing 2, it would also be possible to use a gear coupling or a toothed gear system, as illustrated in FIG. 11. In particular, a ring gear may be provided in the circumferential region of the round magazine 19, which is coupled in displacement with a pinion 98 of the automatically controlled transport mechanism 16. It is of advantage if the drive unit 17 of the transport mechanism 16 is provided in the form of a motor with an integrated brake, for example a cone rotor motor of the type described above, in particular a cone rotor-asynchronous motor.

As also illustrated in FIG. 11, the drive system 13 for the closure mechanism 7 may also be disposed or mounted directly on the closure mechanism 7 or directly on each of the slides 11. In particular, a drive system 13 of this type is preferably mounted in one of the terminal end regions or narrow faces of the slide 11, in which case the output of the drive system 13 co-operates with a housing-side, stationary element. If the drive system 13 is a drive pinion as schematically illustrated, the housing-side element mounted in the region of the guide mechanism 33 is a toothed rack 99. Instead of a positive drive connection, however, it would also be possible to opt for a frictional connection between the drive system 13 and its co-operating or actively coupled element, as described above. When the drive system 13 is activated via the control system 14, the drive system 13, in particular the drive motor, then moves simultaneously with the slide 11 as indicated by arrows 26 and 28. In particular, the drive system 13 moves jointly with the slide 11 along the displacement range pre-defined by the guide mechanism 33, at least in one direction and preferably in two directions, in an automatically controlled manner.

In order to transmit electric power and/or signals between the control system 14 and the drive system 13, a trailing cable arrangement 100 may be provided, at least in certain portions. In order to transmit driving power and/or control commands between the control system 14 and the drive system 13, the position of which can be varied, another slide contact arrangement of the type described above may be provided.

The storage machine 1 illustrated also has the motion monitoring system 65 for the compartment system 4, in particular for the carousel-type round magazine 19. The motion monitoring system 65 in this instance is independent of and separate from the local, primary control system 14 of the storage machine 1 and unlocking and/or opening of the closure mechanisms 7 can be prevented independently of control commands or evaluation results of the control system 14.

The illustrated storage machine 1 also has the control device 58 for the closed state of the closure mechanism 7 or slide 11. It is independent of and provided in addition to the actual control system 14 of the storage machine 1 and is able to prevent a movement of the transport mechanism 16 independently of control commands or evaluation results of the control system 14.

The tumbler 30 for the closure mechanism 7 or slides 11, which is either provided separately or is formed by one of the stop mechanisms 31, is automatically unlocked as a function of the automatically verified access rights of the respective user, as a function of the adjusting or positioning procedures of the compartment system 4 and as a function of the end of the adjusting or positioning procedures of the stop mechanism 31. By preference, this is not done exclusively by the control system 14, and instead an authorization signal or a power authorization must be emitted by the motion monitoring system 65 and/or the control device 58.

Due to the independent or separate motion monitoring system 65 or control device 65, a high functional safety of the storage machine 1 is obtained, without the need for complex, expensive control software for the central or primary control system 14 of the storage machine which requires a lot of maintenance and modification. This high functional safety obtained for automating the storage machine 1 also results in better personal and access safety because critical or risky operating states of the storage machine 1 are ruled out to a high degree of probability. In particular, an individual error in the sequence control or in the control system 14 will still not result in a critical operating state of the machine. Above all, the system is based on increased fail safety, in particular a single fault failsafe system, as regards detecting the closed state of the closure mechanism 7 and/or as regards detecting whether the compartment system 4 is stationary.

Figure 12:
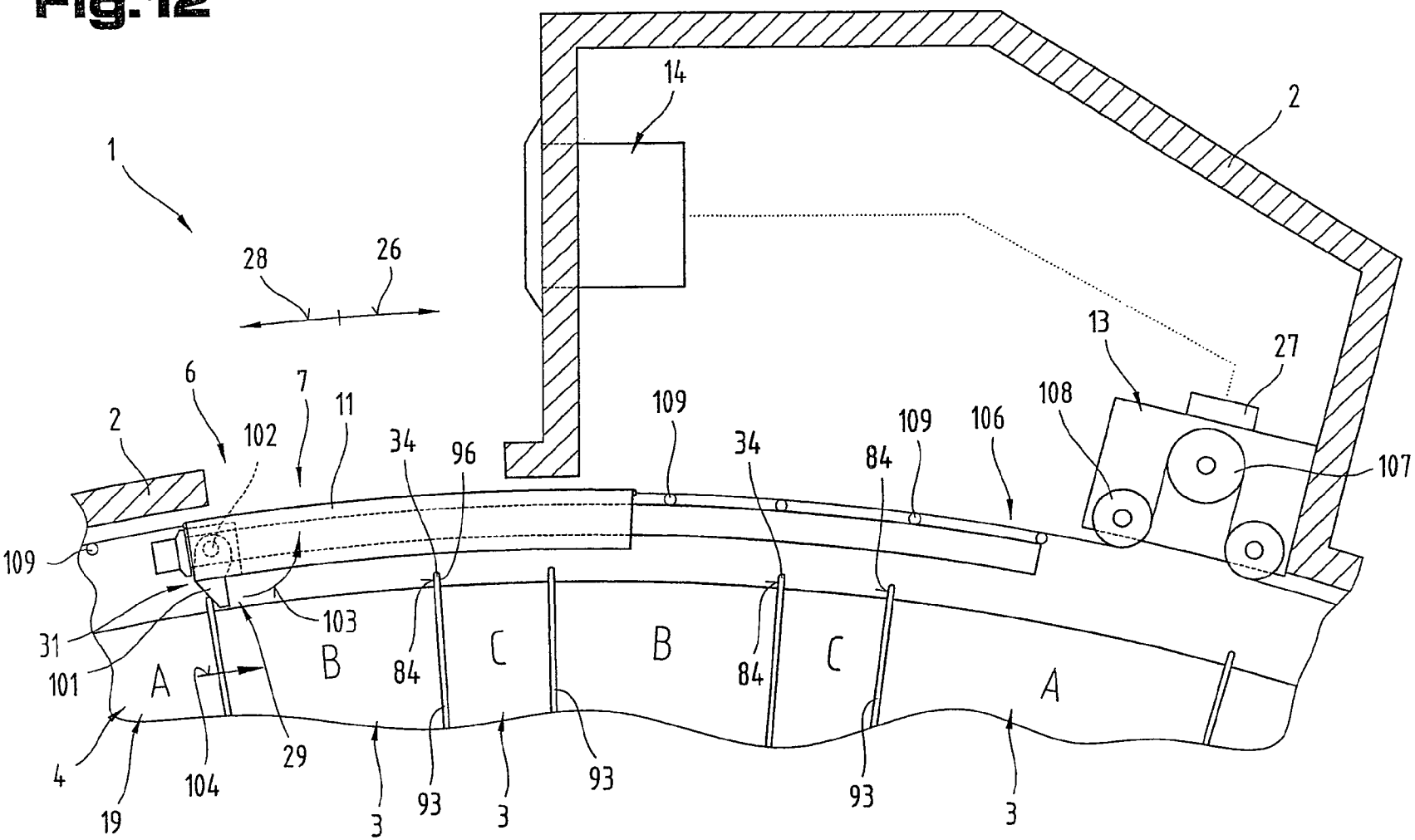
Figure 19:
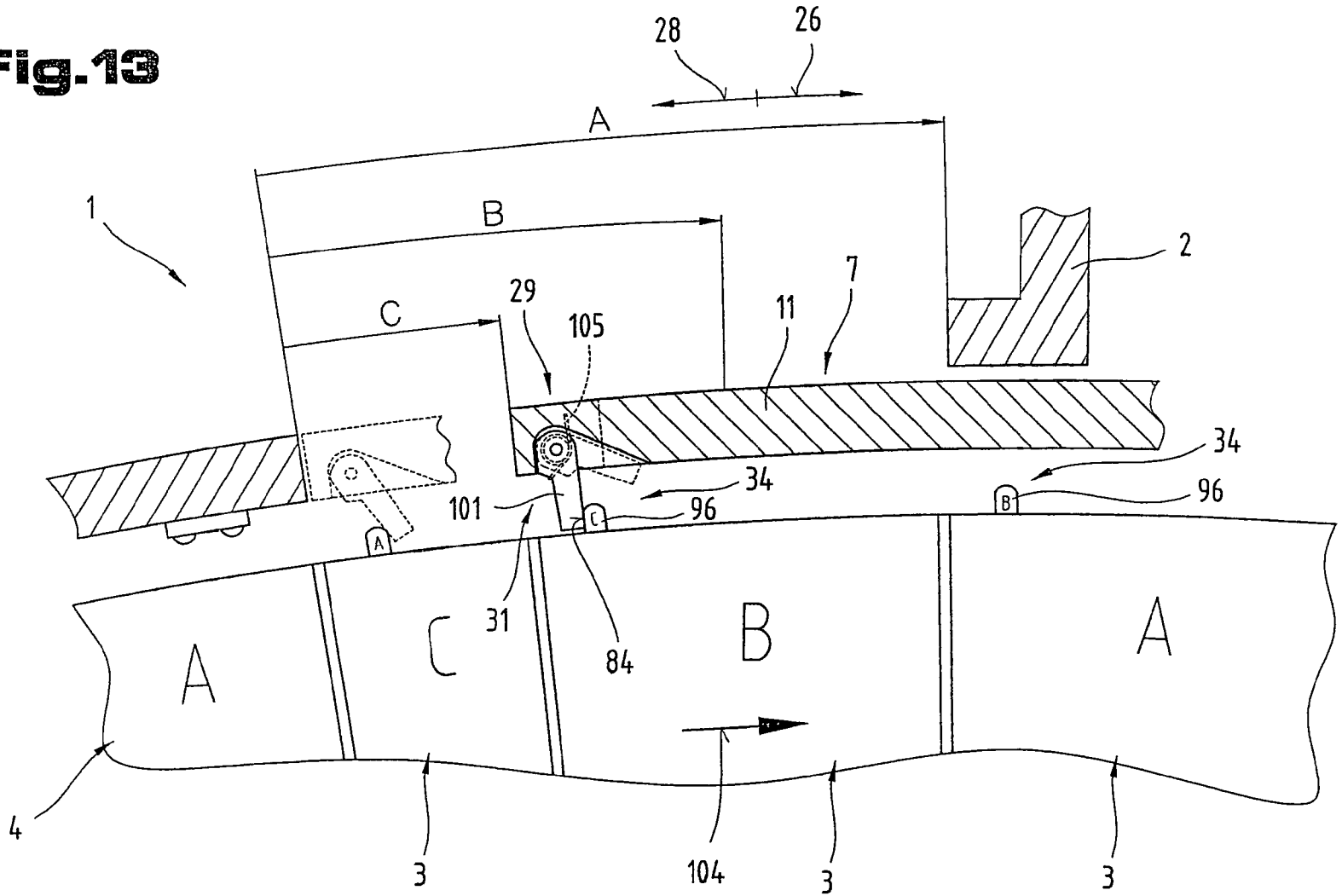

FIGS. 12 and 13 illustrate another embodiment in which at least one stop mechanism 31 is retained or mounted on or in the closure mechanism 7 or on or in the respective slide 11. This at least one stop mechanism 31 co-operates with one or several stop surfaces 84 on projections 96 or alternatively on recesses 95 on the compartment system 4 spaced apart from one another in the direction in which the closure mechanism 7 or slide 11 is moved. Specifically with the embodiment illustrated in FIG. 12, the stop mechanism 31 acts on the compartment dividing walls 93 or on another compartment boundary of the respective compartment 3 in order to limit the movement or opening.

The embodiment illustrated in FIG. 12 is a stop mechanism 31 which can be activated and deactivated in a controlled manner and which has a pawl 101 which can be activated in a controlled manner. The pawl 101 is mounted in a terminal edge region or on the internal face in the interior of the closure mechanism 7 or slide 11 so as to be pivotable about a vertically extending pivot axis 102. When the closure mechanism 7 or slide 11 is moved in the closing direction, indicated by arrow 28, the stop mechanism 31 is inactive. When the closure mechanism 7 or slide 11 is moved in the opening direction, indicated by arrow 26, on the other hand, the stop mechanism 31, in particular its pawl 101, is active or can be activated if the pawl 101 has moved into abutment with one of the stop surfaces 84, in particular into one of the stop positions 34. In other words, the opening restriction 29 comes into play in this instance if the pawl 101 is moved into abutment with or moves against a stop surface 84, in particular a projection 96. Any further opening or further movement of the slide 11 in the opening direction, indicated by arrow 26, is therefore restricted by the stationary compartment system 4 and its stop surfaces 84. The various stop surfaces 84 are positioned in such a way that it is essentially possible to access only the specific compartment 3 of the corresponding size A, B or C for which access is authorized.

The pawl 101 can be pivoted in the direction towards the internal face of the closure mechanism 7 indicated by arrow 103, so that the pawl 103 moves towards the closure mechanism 7 or slide 11. When the pawl 101 is pivoted in the direction opposite that indicated by arrow 103, it moves away from the internal face of the closure mechanism 7 or slide 11 and ultimately stops in a defined, outwardly pivoted position. This maximum outwardly pivoted position, illustrated in the diagram of FIG. 12 for example, is preferably restricted by means of co-operating stop surfaces on the pawl 101 and on the closure mechanism 7 or slide 11.

As a result, the round magazine 19 can be set in motion, in particular in a rotating motion, as indicated by arrow 104, by means of the transport mechanism 16, which is not illustrated here, and the individual stop positions 34 can be overcome without any difficulty once the stop mechanism 31 is inactive, in particular its pawl 101. In other words, a rotation of the round magazine 19 is possible in one direction, even though the pawl 101 is in the position pivoted or moved away from the closure mechanism 7. However, the round magazine 19 can only be rotated in the direction opposite arrow 104 within the path or distance between two stop positions 34, between which the pawl 101 or stop mechanism 31 is positioned.

In the embodiment illustrated in FIGS. 12, 13, it is therefore easily possible for the round magazine 19 to effect a rotating movement in one direction indicated by arrow 104, thereby enabling the relevant compartment 3 to be positioned behind the access orifice 6 accordingly. The tumbler 30, which is not illustrated, is then deactivated and the drive system 13 can then be activated automatically and in a controlled manner and the closure mechanism 7 can be opened as far as the stop position 34 defined by the stop mechanism 31 and the stop surfaces 84. An automatic opening movement is then effected with a limited force, in particular due to a drive which is retained by friction or by a force limiting device 27 in the drive train between the drive system 13 and the closure mechanism 7. Any further opening by hand beyond the stop position 34 is reliably prevented due to the locking action of the pawl 101. The closure mechanism 7 is automatically closed in the direction of arrow 28 but only with a defined, limited driving force. A manual closing operation may also be possible, in particular by manually pushing the slide 11 closed, because the force coupling or the coupled movement between the drive system 13 and the slides 11 or closure mechanism 7 is limited in terms of force or torque and is not self-inhibiting but rather is effected largely freely.

Instead of the embodiment based on an automated, for example electromagnetically switchable, pawl 101, it is also possible to use a resiliently elastic, pre-tensioned pawl 101 on or in the respective slides 11. In particular, a biasing or spring means 105 may be provided, which constantly forces the pawl 101 into the outwardly pivoted position, e.g. more or less as illustrated in the diagram of 13. This being the case, the spring means 105 may be made from an elastomeric material or component, provided in the form of mechanical spring elements, a gas pressure storage, oil pressure storage or similar. When the compartment system 4 moves as indicated by arrow 104 relative to the closure mechanism 7 or relative to the stop mechanism 31, the pawl 101 is inactive, in which case it is able to pass or slide over the stop surfaces 84 or beyond the stop positions 34. When the closure mechanism 7 or the slide 11 moves in the opening direction, indicated by arrow 26, the stop mechanism 31 then comes into play when the pawl 101 sits in abutment with the stop position 34 or stop surface 84 corresponding to the compartment size. Due to the fact that the compartment system 4 is prevented from rotating when it is stationary, any inadmissible pushing of the closure mechanism 7 beyond the stop position 34 between the pawl 101 and a stop surface 84 is reliably prevented.

One advantage of the embodiment illustrated in FIG. 13 is that it obviates the need for electromagnetic drives or power and/or signal transmissions between the slides 11 and an element or portion secured to the housing. Also with the embodiment illustrated in FIG. 13, the compartment system 4 and the drive which moves it is of a design retained by friction or braked, which means that when the compartment system 4 assumes a defined position and once it has reached a standstill, a very firm and non-variable position of the compartment system 4 is obtained which can not be manually overcome.

Instead of an outwardly pivotable pawl 101, it would also be possible for a bolt or hook to be extracted from the closure mechanism 7, in which case the maximum opening distance of the closure mechanism 7 or the respective slide 11 could be restricted in the same way as with the pawl 101.

As illustrated in FIG. 12, the coupled movement between the drive system 13 and the slides 11 may also be achieved on the basis of a belt or cable arrangement 106. In particular, one end of a cable is connected to a first terminal end of the slide 11 and the other end of the cable is connected to the oppositely lying terminal end of the slide 11. Alternatively, it would also be possible to provide an endless cable or belt, in which case it is preferably attached to a point of the slide 11, preferably on the internal face. The belt or cable of the cable arrangement 106 is fed round a driving pulley 107 of the drive system 13. In addition, at least one guide pulley 108 is provided, by means of which the belt or cable is fed or guided at a corresponding looping angle around the driving pulley 107. Due to controlled and reversible rotating movements of the drive system 13, in particular the driving pulley 107, the opening and closing movements of the slide 11 indicated by arrow 26 and arrow 28 can be effected in a simple manner. The belt or cable may be guided in the external circumferential region of the housing 2. In particular, it is of advantage to guide the cable in a circle around the round magazine 19. Alternatively, however, it would also be possible to guide the cable in a loop with pulling and slack strands disposed close to one another.

Guide elements 109, for example guide pins or guide rollers, prevent the belt-type tension element, in particular the cable or a chain, from coming into contact with or moving on the compartment system 4 or on the internal faces of the machine housing 2.

The embodiments illustrated as examples represent possible design variants of the storage machine 1 and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

It should also be pointed out that the descriptions of the various drawings may be read in conjunction with the other drawings, especially where the same parts are denoted by the same reference numbers. In particular, parts of the descriptions given with respect to drawings later on may also be read in conjunction with the descriptions of earlier drawings.

For the sake of good order, finally, it should be pointed out that, in order to provide a clearer understanding of the structure of the storage machine 1, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1, 2; 3; 4, 5; 6; 7; 8; 9; 10; 11; 12; 13 constitute independent solutions proposed by the invention in their own right. The objectives and associated solutions proposed by the invention may be found in the detailed descriptions of these drawings.

LIST OF REFERENCE NUMBERS

1 Storage machine
2 Machine housing
3 Compartment
4 Compartment system
5 Access mechanism
6 Access orifice
7 Closure mechanism
8 Width
9 Compartment width
10 Height
11 Slide
12 Opening width
13 Drive mechanism
14 Control system
15 Individual access orifice
16 Transport mechanism
17 Drive unit
18 Axis
19 Round magazine
20 Rotary drive
21 User interface
22 Terminal
23 Input and/or output device
24 Identification and/or authorization checking means
25 Scanner
26 Arrow
27 Device
28 Arrow
29 Opening restriction
30 Tumbler
31 Stop mechanism
32 Bearing mechanism
33 Guide mechanism
34 Stop position
35 Stage
36 Stop element
37 Command input means
38 OK button
39 Portion
40 Portion
41 Roller
42 Guide rail
43 Support roller
44 Flat face
45 Motion transmitting means
46 Toothed rack
47 Drive pinion
48 Power adjusting element
49 Axis
50 Pivot angle
51 Retaining element
52 Support shaft
53 Actuator drive
54 Gear system
55 Braking and/or blocking device
56 Actuator part
57 Coupling element
58 Control device
59 Switch
60 Control contact
61 Detection system
62 Sensor
63 Evaluation device
64 Photoelectric barrier system
65 Motion monitoring system
66 Sensor
67 Bridging device
68 OK button
69 Motion transmitting means
70 End
71 End
72 Driving pulley
73 Guide pulley
74 Restrictor element
75 Restrictor element
76 Oblique surface
77 Eccentric plate
78 Rotation axis
79 Threaded spindle arrangement
80 Threaded spindle
81 Spindle bearing
82 Drive
83 Terminal end
84 Stop surface
85 Piston-cylinder arrangement
86 Moving nut arrangement
87 Threaded spindle
88 Drive
89 Threaded nut
90 Slide guide element
91 Friction drive
92 Slide contact arrangement
93 Compartment dividing wall
94 Compartment base
95 Recess
96 Projection
97 Braking and/or blocking device
98 Pinion
99 Toothed rack
100 Trailing cable arrangement
101 Pawl
102 Pivot axis
103 Arrow
104 Arrow
105 Spring means
106 Cable arrangement
107 Driving pulley

108 Guide pulley
109 Guide element

The invention claimed is:

1. A storage machine for storing objects, comprising a compartment system comprising a plurality of compartments and at least one closure mechanism;

a machine housing at least partially enclosing said compartments, said machine housing comprising a central predefined access orifice;

at least one drive system to permit a controlled movement of the closure mechanism; and a control system;

wherein said at least one closure mechanism can be moved relative to the central predefined access orifice in order to permit or prevent access to a specific, individual compartment or to a specific group of adjacent compartments;

wherein the opening width of the closure mechanism or the ability to move the closure mechanism depends on a user access right of an authorized user or the respective width of a compartment;

wherein said user access right can be verified by the control system;

wherein said at least one drive system comprises a driving force that is dimensioned or adjusted so that the maximum force or torque transmission values acting on the closure mechanism is configured so that automatic movements of the closure mechanism cannot cause serious injuries to a user; or wherein the storage machine comprises a drive train or a motion transmitting path between the drive system and the closure mechanism that includes a force or torque limiting device, wherein said force or torque limiting device is configured so that the maximum force or torque transmission values acting on the closure mechanism is adjusted so that automatic movements of the closure mechanism cannot cause serious injuries to a user;

wherein the closure mechanism can be manually stopped or pushed in spite of the drive system being active;

wherein the closure mechanism or drive system comprises at least one stop mechanism which can be activated and/or deactivated in a controlled manner or positioned in a controlled manner;

wherein said at least one stop mechanism is designed to mechanically restrict the opening width of the closure mechanism to a maximum opening width depending on the size of the compartment for which access is granted by the control system or for a compartment group for which access is granted by the control system.

2. The storage machine according to claim 1, wherein the drive system is deactivated by the control system after a predefined period has elapsed and if a desired position of the closure mechanism is not reached.

3. The storage machine according to claim 1, wherein the control system automatically positions or activates the at least one stop mechanism depending on the width of the compartment to be accessed.

4. The storage machine according to claim 1, wherein the maximum closing forces transmitted to the closure mechanism by the drive system or force or torque limiting device can be overcome manually.

5. The storage machine according to claim 1, wherein the at least one stop mechanism includes blocking or locking forces that cannot be overcome by mere manual forces.

6. The storage machine according to claim 1, wherein the closure mechanism further includes an opening restriction wherein said opening restriction can be automatically moved and configured by the control system to the maximum opening width based on the respective access rights of a user.

7. The storage machine according to claim 1, wherein said at least one stop mechanism further includes stop positions, wherein said at least one stop mechanism, or a controllable, mechanical opening restriction for the closure mechanism, sets the positions of said stop positions, wherein said positions can be variably positioned; or wherein said at least one stop mechanism or mechanical opening restriction defines at least two stop positions spaced apart from one another in the opening direction of the closure mechanism.

8. The storage machine according to claim 1, wherein the at least one closure mechanism comprises several stop mechanisms activatable and deactivatable in a controlled manner for different stop positions or opening widths.

9. The storage machine according to claim 1, wherein the closure mechanism optionally co-operates with a tumbler; wherein the at least one stop mechanism is respectively positioned or set on a timed basis prior to an opening movement of the drive system; and/or the at least one stop mechanism is respectively positioned or set on a timed basis prior to the controlled release of the tumbler on an automatic basis.

10. The storage machine according to claim 1, wherein a maximum driving or closing force which can be generated by the drive system lies below a fixed threshold value critical to injury or risk.

11. The storage machine according to claim 1, wherein the driving force of the drive system is limited by an electrically acting current or torque restriction.

12. The storage machine according to claim 11, wherein the electrically acting current or torque restriction comprises a controllable power adjusting element wherein the driving force for the drive system is influenced by said power adjusting element.

13. The storage machine according to claim 1, wherein the drive system transmits a closing force to the closure mechanism, wherein said closing force is limited by the force or torque limiting device, and wherein the closing force is restricted in a controlled manner.

14. The storage machine according to claim 13, wherein the force or torque limiting device comprises a slip clutch, a friction drive, a centrifugal coupling, or a coupling which reversibly breaks the drive connection in the event of overload or when a threshold value is exceeded.

15. The storage machine according to claim 1, wherein the at least one stop mechanism comprises a stop element (which can be electromagnetically positioned or activated.

16. The storage machine according to claim 1, wherein the at least one stop mechanism comprises a threaded spindle arrangement or a moving nut arrangement which can be positioned in a controlled manner.

17. The storage machine according to claim 1, wherein the at least one stop mechanism comprises a gear system acting on the basis of friction.

18. The storage machine according to claim 1, wherein the at least one stop mechanism has an individually actuatable actuator drive.

19. The storage machine according to claim 1, further comprising a single actuator drive and/or a stop element, wherein said single actuator drive selectively activates and deactivates the at least one stop mechanism, or the stop element out of a plurality of co-operating mutually spaced stop mechanisms or stop elements.

20. The storage machine according to claim 1, further comprising an automatically activated brake or blocking device, wherein the at least one stop mechanism (31) is fixed at the respective appropriate position using the automatically activated brake or blocking device based on the maximum opening width or positioning width of the closure mechanism permissible.

21. The storage machine according to claim 20, wherein the braking or blocking device applies a braking or blocking force to the closure mechanism which can not be overcome by manual force.

22. The storage machine according to claim 1, wherein the at least one stop mechanism is active in the powerless or current-free state.

23. The storage machine according to claim 1, wherein the at least one stop mechanism comprises a mechanically bistable design, and said at least one stop mechanism assumes one of two mechanically defined positions wherein said at least one stop mechanism is not supplied with electric power: including: 1) a powerless first state defining an active position that permanently produces an opening restriction in the powerless first state; and 2) a powerless second state defining an inactive position that permanently produces an opening restriction in the powerless second state.

24. The storage machine according to claim 1, further comprising a means of locking the closure mechanism in its fully closed position, wherein said locking means includes the at least one stop mechanism and/or a separate tumbler.

25. The storage machine according to claim 24, wherein the tumbler can be released by the control system depending on the existence of automatically verified access rights of a user.

26. The storage machine according to claim 1, further comprising a sensor-based control device, wherein said sensor-based control device actively switches a release signal when the closure mechanism is in the fully closed position.

27. The storage machine according to claim 1, further comprising a control device and locking tumblers, wherein the control device signals the state of the fully closed closure mechanisms, and the state of closure mechanisms that are mechanically locked by tumblers.

28. The storage machine according to claim 1, further comprising an electromechanically releasable tumbler, wherein said electromechanically releasable tumbler is locked in the powerless state so that a closed closure mechanism cannot be accessed.

29. The storage machine according to claim 1, further comprising a control device, and a photelectric barrier system, wherein the control device includes a means for monitoring or detecting several closure mechanisms and for sensing their closed state using the photoelectric barrier system.

30. Storage The storage machine according to claim 29, wherein the photoelectric barrier system is interrupted if at least one of the closure mechanisms is not in the fully closed state.

31. The storage machine according to claim 1, further comprising a control device and a locked tumbler on the closure mechanism; wherein the effect of a locked tumbler on the closure mechanism is checked by the drive system in conjunction with the signal of the control device to determine the occurrence of an attempt to open the closure mechanism and to determine the closed state of the closure mechanism.

32. The storage machine according to claim 1, wherein the at least one stop mechanism is disposed on or in the closure mechanism and is displaceable relative to the access orifice.

33. The storage machine according to claim 32, wherein the at least one stop mechanism cooperates with one of several stop elements or stop surfaces; wherein said stop elements or stop surfaces are disposed in the direction in which the closure mechanism is moved and are disposed in the interior of the machine housing.

34. The storage machine according to claim 32, wherein the at least one stop mechanism is designed to mechanically abut a compartment boundary, wherein the compartment boundary includes a compartment dividing wall.

35. The storage machine according to claim 32, wherein the at least one stop mechanism comprises a pawl; wherein said pawl prevents relative movements between the closure mechanism and the compartment system beyond a maximum permissible opening width in the active or projecting position.

36. The storage machine according to claim 35, wherein the pawl is mounted so as to be pivotable and said pawl is constantly forced into a projecting or outwardly pivoted position by a spring means.

37. The storage machine according to claim 35, wherein the pawl can be moved in a controlled manner and is in the projecting or active position when said pawl is not supplied with power; and said pawl is in the retracted or deactivated position when said pawl is supplied with power.

38. The storage machine according to claim 1, further comprising a controllable transport mechanism; wherein the compartment system co-operates with the controllable transport mechanism in order to move the compartments or the compartment system relative to the access orifice in the machine housing.

39. The storage machine according to claim 38, further comprising a braking and/or locking device; wherein the transport mechanism or compartment system co-operates with the braking and/or locking device for rapidly terminating and/or reliably blocking movements.

40. The storage machine according to claim 1, wherein the compartment system comprises a round magazine that is rotatable about a vertical axis and further includes a co-operating, controllable rotary drive.

41. The storage machine according to claim 1, further comprising a motion monitoring system; wherein the compartment system, is a carousel-type round magazine co-operating with the motion monitoring system.

42. The storage machine according to claim 41, wherein the motion monitoring system is independent of and separate from a local, primary control system of the storage machine; wherein the motion monitoring system is able to release and/or open the closure mechanisms independently of control commands or evaluation results of the control system.

43. The storage machine according to claim 1, further comprising a control devices and a transport mechanism; said control device determining the closed state of the closure mechanism; said control device performing independently of and in addition to the actual control system of the storage machine; and said control device being able to prevent a movement of the transport mechanism independently of control commands or evaluation results of the control system.

44. The storage machine according to claim 1, further comprising a control device for monitoring the closed state of the closure mechanism and a bridging device; wherein said control device can be temporarily and deliberately bridged by a user by the bridging device.

45. The storage machine according to claim 44, further comprising a transport mechanism for the compartment system, wherein the bridging device operates on the basis of failsafe technology and includes three-stage OK buttons; wherein said transport mechanism can be immediately brought to a halt in a panic position both when the OK button is released and when the OK button is depressed.

46. The storage machine according to claim 44, wherein the bridging device comprises two three-stage OK buttons;

wherein said OK buttons are spaced apart from one another so that the user has to use both hands in order to operate the buttons simultaneously.

47. The storage machine according to claim 44, further comprising a transport mechanism for the compartment system; wherein when the bridging device is activated, a transport mechanism is operated at a reduced speed.

* * * * *

UNITED STATES PATENT AND TRADEMARK OFFICE

CERTIFICATE OF CORRECTION

PATENT NO. : 7,925,375 B2
APPLICATION NO. : 11/596511
DATED : April 12, 2011
INVENTOR(S) : Schininger et al.

It is certified that error appears in the above-identified patent and that said Letters Patent is hereby corrected as shown below:

Column 35, line 48 (line 1 of Claim 30), please delete the word: "Storage" (first occurrence).

Signed and Sealed this
Twenty-fourth Day of May, 2011

David J. Kappos

David J. Kappos
*Director of the United States Patent and Trademark Office*